US010575637B2

(12) United States Patent
Wohlgenannt

(10) Patent No.: US 10,575,637 B2
(45) Date of Patent: Mar. 3, 2020

(54) DRIVE DEVICE FOR A MOVEABLE FURNITURE PART

(71) Applicant: Julius Blum GmbH, Hoechst (AT)

(72) Inventor: Daniel Wohlgenannt, Bregenz (AT)

(73) Assignee: JULIUS BLUM GMBH, Hoechst (AT)

( * ) Notice: Subject to any disclaimer, the term of this patent is extended or adjusted under 35 U.S.C. 154(b) by 66 days.

(21) Appl. No.: 15/861,139

(22) Filed: Jan. 3, 2018

(65) Prior Publication Data

US 2018/0160807 A1 Jun. 14, 2018

Related U.S. Application Data

(63) Continuation of application No. PCT/AT2016/050230, filed on Jun. 24, 2016.

(30) Foreign Application Priority Data

Jul. 7, 2015 (AT) ..... 50593/2015

(51) Int. Cl.
*A47B 88/463* (2017.01)
*A47B 88/47* (2017.01)
(Continued)

(52) U.S. Cl.
CPC ..... *A47B 88/463* (2017.01); *A47B 88/47* (2017.01); *E05C 19/022* (2013.01);
(Continued)

(58) Field of Classification Search
CPC ..... A47B 2088/4235; A47B 88/45; A47B 88/463; A47B 88/47; A47B 88/467;
(Continued)

(56) References Cited

U.S. PATENT DOCUMENTS 9,295,328 B2 3/2016 Brunnmayr
9,386,850 B2 7/2016 Dubach
(Continued)

FOREIGN PATENT DOCUMENTS

CN 102245054 11/2011
CN 103313627 9/2013
(Continued)

OTHER PUBLICATIONS

Search Report dated Nov. 19, 2015 in corresponding Chinese Patent Application No. 201680039807.3.
(Continued)

*Primary Examiner* — Daniel J Troy
*Assistant Examiner* — Timothy M Ayres
(74) *Attorney, Agent, or Firm* — Wenderoth, Lind & Ponack, L.L.P.

(57) ABSTRACT

A drive device for a movable furniture part, in particular for a drawer, includes a push-out device for pushing the movable furniture part out of a closed position into an open position, and includes a locking device for locking the push-out device in a locked position. The locking device has a locking guide track, which is in particular cardioid, and a locking pin movable and lockable in the locking guide track. A control device is provided which is separate from the locking guide track and from the locking pin, and the movement of the locking pin in the locking guide track can be at least partially controlled by the control device.

22 Claims, 34 Drawing Sheets

(51) Int. Cl.

| | |
|---|---|
| ***E05C 19/02*** | (2006.01) |
| ***E05C 19/06*** | (2006.01) |
| ***E05F 1/16*** | (2006.01) |
| *A47B 88/423* | (2017.01) |

(52) U.S. Cl.
CPC ..... *E05C 19/063* (2013.01); *E05F 1/16* (2013.01); *A47B 2088/4235* (2017.01); *E05Y 2900/20* (2013.01)

(58) Field of Classification Search
CPC . E05Y 2900/20; E05C 19/022; E05C 19/063; E05F 1/16
USPC ..... 312/333
See application file for complete search history.

(56) References Cited

U.S. PATENT DOCUMENTS

| | | | | |
|---|---|---|---|---|
| 9,386,851 | B2 * | 7/2016 | Dubach | A47B 88/47 |
| 9,532,648 | B2 | 1/2017 | Gasser et al. | |
| 9,622,578 | B2 | 4/2017 | Goetz et al. | |
| 9,642,461 | B2 | 5/2017 | Goetz et al. | |
| 9,655,447 | B2 | 5/2017 | Brunnmayr et al. | |
| 9,717,334 | B2 | 8/2017 | Goetz et al. | |
| 9,775,434 | B2 * | 10/2017 | Flogaus | A47B 88/467 |
| 9,968,191 | B2 * | 5/2018 | Albrecht | A47B 88/45 |
| 10,251,481 | B2 * | 4/2019 | Goetz | E05F 1/16 |
| 2006/0087128 | A1 | 4/2006 | Salice | |
| 2009/0307869 | A1 * | 12/2009 | Salice | E05C 19/022 16/85 |
| 2013/0140970 | A1 | 6/2013 | Dubach | |
| 2014/0312627 | A1 * | 10/2014 | Frommann | E05B 83/34 292/57 |
| 2014/0319986 | A1 | 10/2014 | Brunnmayr | |
| 2015/0374123 | A1 | 12/2015 | Goetz et al. | |
| 2015/0374124 | A1 | 12/2015 | Brunnmayr et al. | |
| 2015/0374125 | A1 | 12/2015 | Goetz et al. | |
| 2016/0007748 | A1 | 1/2016 | Gasser et al. | |
| 2016/0007750 | A1 | 1/2016 | Goetz et al. | |
| 2016/0206093 | A1 | 7/2016 | Brunnmayr et al. | |
| 2016/0227927 | A1 * | 8/2016 | Goetz | A47B 88/407 |
| 2018/0125235 | A1 * | 5/2018 | Wohlgenannt | A47B 88/47 |
| 2018/0160808 | A1 * | 6/2018 | Wohlgenannt | A47B 88/463 |

FOREIGN PATENT DOCUMENTS

| | | |
|---|---|---|
| CN | 104135894 | 11/2014 |
| DE | 20 2008 013 230 | 4/2010 |
| EP | 2 208 441 | 7/2010 |
| JP | 2004-344187 | 12/2004 |
| JP | 2013-526351 | 6/2013 |
| TW | 200501902 | 1/2005 |
| TW | 201110911 | 4/2011 |
| WO | 2007/039541 | 4/2007 |
| WO | 2011/143682 | 11/2011 |
| WO | 2014/165873 | 10/2014 |
| WO | 2014/165874 | 10/2014 |
| WO | 2014/165877 | 10/2014 |
| WO | 2014/165878 | 10/2014 |
| WO | 2015/051386 | 4/2015 |

OTHER PUBLICATIONS

International Search Report dated Sep. 19, 2016 in International (PCT) Application No. PCT/AT2016/050230.

* cited by examiner

St. d. T.

St.d.T.

SS + VS

ÜS + ES + B2

VS

SS

DRIVE DEVICE FOR A MOVEABLE FURNITURE PART

BACKGROUND OF THE INVENTION

1. Field of the Invention

The present invention relates to a drive device. In addition, the invention relates to an item of furniture with such a drive device for a movable furniture part.

2. Description of the Related Art

Since already many years there are various auxiliary devices in the industry of furniture fittings in order to facilitate the movement of a movable furniture part (for example drawers, furniture doors or furniture flaps) from a closed position in opening direction for a user. For that purpose, especially so-called touch-latch-mechanisms or TIP-ON devices are used which mostly comprise cardioid-shaped locking guide tracks for a locking pin. In that case, an unlocking and subsequent ejecting is triggered by over-pressing the movable furniture part into an over-pressing position located behind the closed position.

A problem which occurs often in that case is the noise development. Especially when the ejection force storage members must have a relative large ejection force because of relatively heavy drawers which are being moved, loud noises occur especially before and during the locking of the locking pin in the latch recess of the locking guide track because of the impact of the locking pin on the locking guide track.

In order to at least partly solve this problem the WO 2014/165874 A1 teaches a damped locking pin movement. In particular, the locking pin which is acted upon by the stressed ejection force storage member can be placed in the latching movement region in braked and/or damped relationship. In order to reach this according to this document, a relatively large number of components are necessary which act onto the locking pin in a damping or speed-influencing manner. Moreover, a noisy impact of the locking pin on the locking guide track can still occur during the passage from the tensioning section into the latching movement region.

SUMMARY OF THE INVENTION

Therefore, the object of the present invention is to provide an improved drive device compared to the prior art. In particular, the disadvantages of the prior art shall be eliminated and an alternative possibility for a silent movement of the locking pin in the locking guide track shall be provided, respectively.

According to the invention it is provided that a control device—which is separate from the locking guide track and from the locking pin—is provided and the movement of the locking pin in the locking guide track can be at least partially controlled by the control device. Thus, it is possible that not like in the prior art the movement speed of the locking pin but the movement path of the locking pin is influenced in a noise-reducing manner. Especially, for the first time this movement path is no longer only determined by the design of the locking guide track alone. Rather, also a further control device is additionally provided, which is as far as possible independent from the locking guide track. Thus, the movement sequence of the locking pin is additionally guided at least in critical sections.

Preferably it is provided for example that the locking pin is formed on a carrier, wherein the movement of the carrier can be controlled by the control device. This carrier for example can be pivotable about a pivoting axis oriented rectangular to the longitudinal axis. For a compact construction, however, it is preferably provided that the carrier can be rotated about a rotational axis oriented parallel, preferably co-linearly, to the longitudinal axis of the ejection device.

In principle, the control device per se can be formed electronically. Preferably, however, the control device comprises at least two mechanically interacting components which are influencing the path of the locking pin.

In the case of a particularly preferred embodiment it is thus provided that the control device comprises a coupling pin arranged on the carrier and a coupling track, preferably formed in a coupling element, wherein the coupling track comprises a, preferably undercut, holding surface for holding the coupling pin and an inclined section for deflecting the coupling pin into a guiding section of the coupling track.

These components per se can be already sufficient for controlling the movement path of the locking pin. Preferably, however, it is additionally provided that the control device comprises a control track, preferably formed in a housing cover of a housing, and a control pin engaging the control track and arranged on a coupling element, preferably rotatable about the rotational axis. These two additional components make it possible that a rotational movement of the coupling element about the rotational axis is triggered by a movement of the control pin along an inclined deflection control track section of the control track, so that the coupling pin travels from the holding surface into the inclined section of the coupling track in the coupling element.

In principle, the control device could control the movement path of the locking pin in the whole locking guide track. Preferably, however, it is provided that the locking guide track comprises a tensioning section substantially oriented in the longitudinal direction, a curved section, a pre-locking section and a latching section, wherein the movement path of the locking pin is controlled by the control device only in these sections of the locking guide track. This can be carried out in such a way that a rotational movement of the carrier about the rotational axis can be triggered via the locking pin when leaving the tensioning section by means of the coupling pin simultaneously situated in the inclined section of the coupling track and being deflected by this inclined section, and because of this rotational movement of the carrier also the movement of the locking pin along the curved section into the pre-locking section is controlled. Thereby, the pre-locking position is reached silent and in a secure manner.

Subsequently, it can still be provided that a rotational movement of the coupling element about the rotational axis can be triggered by a movement of the control pin along an inclined latching control track section of the control track, wherein the coupling pin engages the guiding section of the coupling track and participates in the rotational movement. Also the carrier is movable relative to the locking guide track by the movement transmission of the rotational movement of the coupling element to the coupling pin, whereby the locking pin—also arranged on the carrier—travels in a controlled silent manner and thus from the pre-locking section via the latching section into the latch recess of the locking guide track.

In principle no pre-locking has to be provided. Therefore, the movement path of the locking pin could also be controlled from the tensioning section directly into the latch recess by means of the control device.

If the ejection device comprises an ejection force storage member and an ejection slider force-actuated by the ejection force storage member, then the ejection slider forms the carrier on which the locking pin is arranged.

For a compact construction with as many functions as possible, the drive device comprises a housing, wherein the ejection device and a retraction device for retracting the movable furniture part from an open position into the closed position are arranged in this common housing.

Protection is also sought for an item of furniture with a furniture carcass, a movable furniture part and a drive device according to the invention.

BRIEF DESCRIPTION OF THE DRAWINGS

Further details and advantages of the present invention are described more fully hereinafter by means of the specific description with reference to the embodiments illustrated in the drawings, in which.

DETAILED DESCRIPTION OF THE INVENTION

Figure 1:
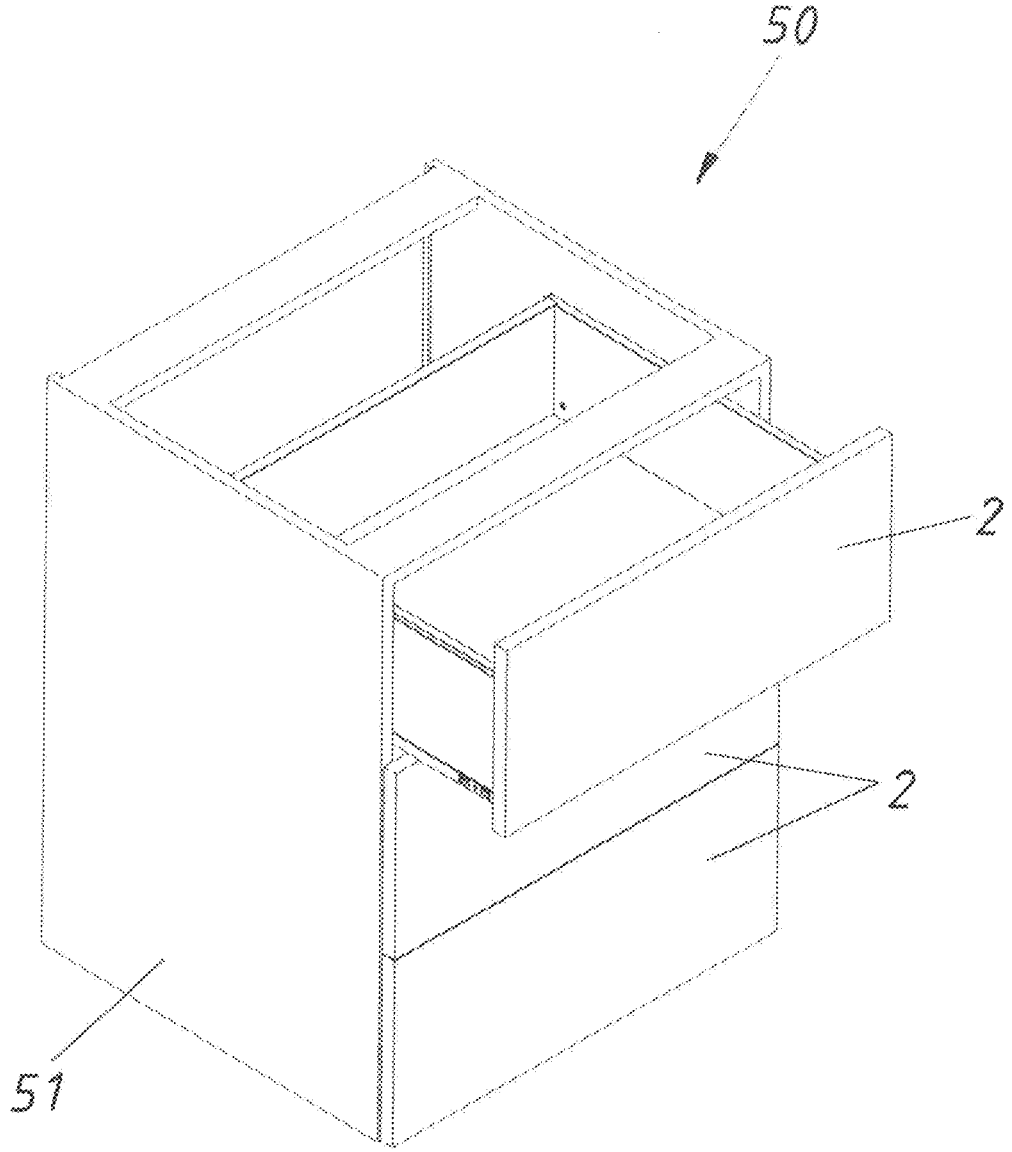
FIG. 1 shows a perspective view of an item of furniture.

FIG. 1 shows in a perspective view an item of furniture 50 with a furniture carcass 51 and three movable furniture parts 2 in form of drawers arranged above each other.

Figure 2:
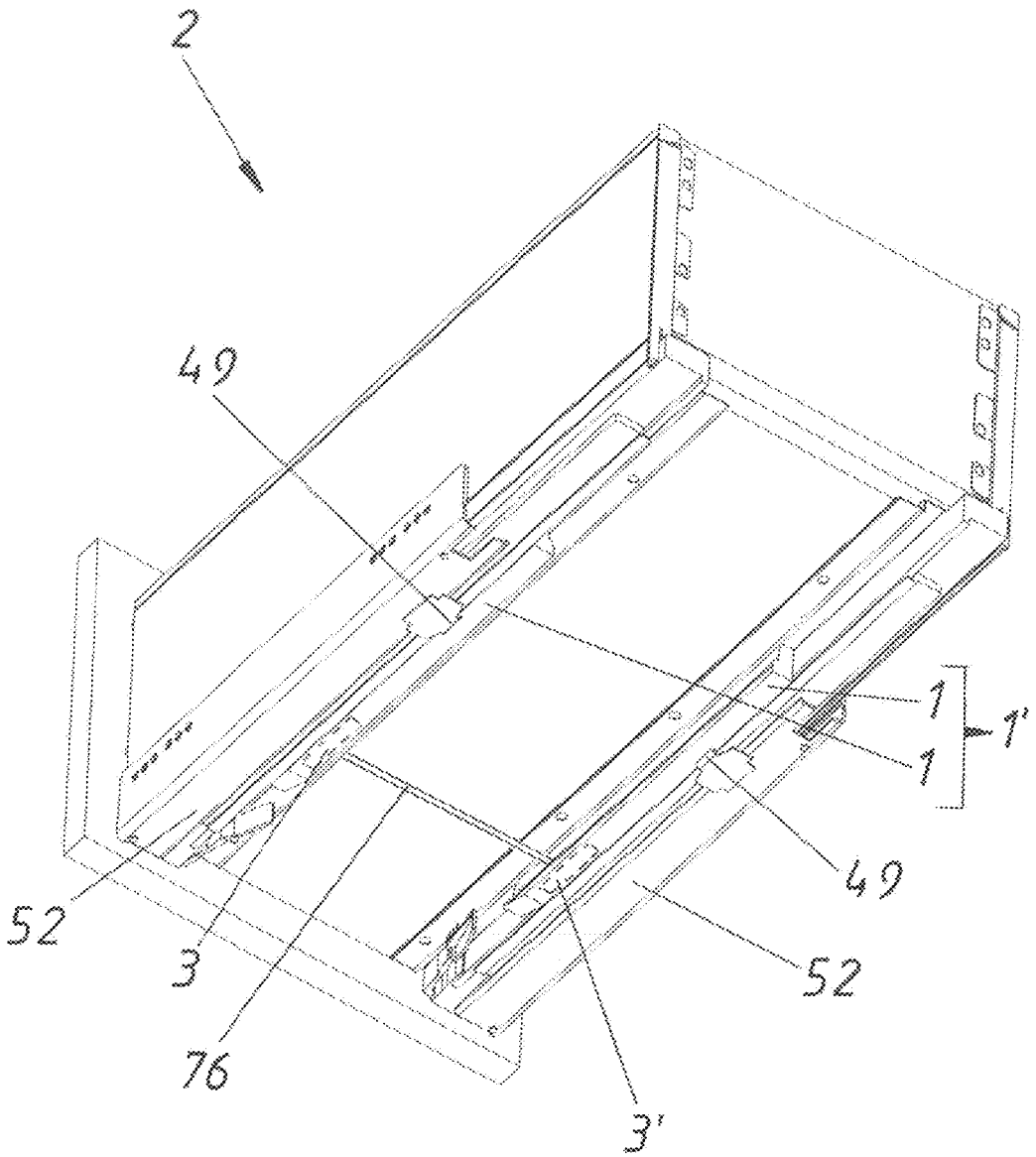
FIG. 2 shows an angled view of the movable furniture from below.

FIG. 2 shows the movable furniture part 2 in an angled view from below, wherein the extension guides 52 are illustrated on the two sides. A drive device 1 for a movable furniture part 2 is arranged on each extension guide 52, especially on each drawer rail 54 of the extension guide 52. When there is a synchronizing device 76 for the ejection devices 3 and 3', then the two drive devices 1—preferably formed mirror-symmetrical to each other—together form one common drive device 1'. A On each bottom side of the carcass rail 53 of the two extension guides 52 a pin-formed entrainment member 49 is attached by means of a holding plate, which entrainment member 49 interacts with the corresponding drive device 1. In this case, each drive device 1 is associated to the movable furniture part 2 (in particular to the drawer rail 54), while the entrainment member 49 is fixed to the furniture carcass 51. Thus, the drive device 1 quasi repels from the fixed entrainment member 49. The described drive device 1 can also be used in an opposite manner, namely that the drive device 1 is mounted to the furniture carcass 51 or to the carcass rail 53 and acts onto the entrainment member 49—which then is associated to the movable furniture part 2. Thereby, the entrainment member 49—together with the movable furniture part 2 connected to the entrainment member 49—is ejected in opening direction OR by the drive device 1.

Figure 3:
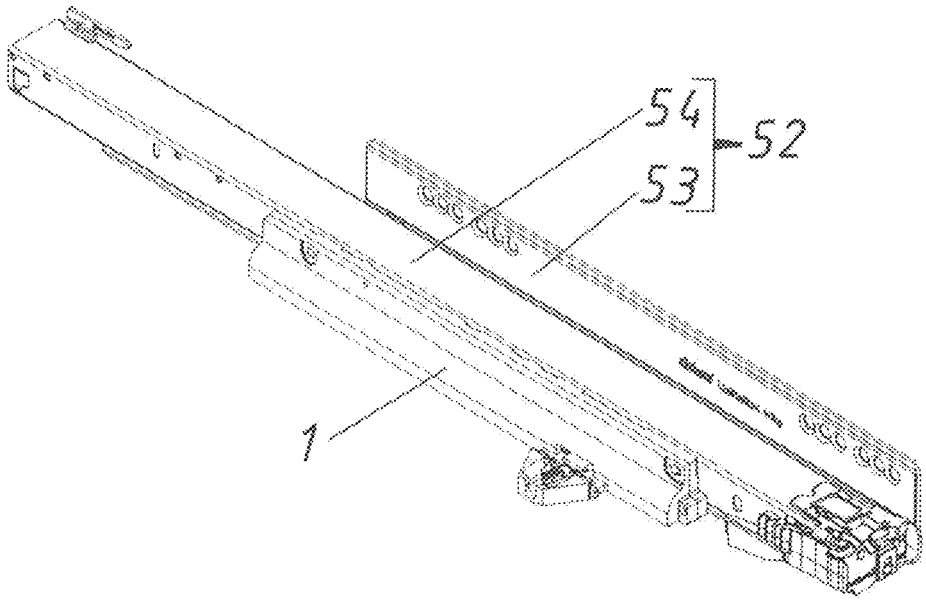
FIG. 3 perspectively shows an extension guide together with a drive device.

FIG. 3 illustrates in a perspective view the extension guide 2 comprising the carcass rail 53 and the drawer rail 54 together with the drive device 1 mounted to the drawer rail 54.

Figure 4A:
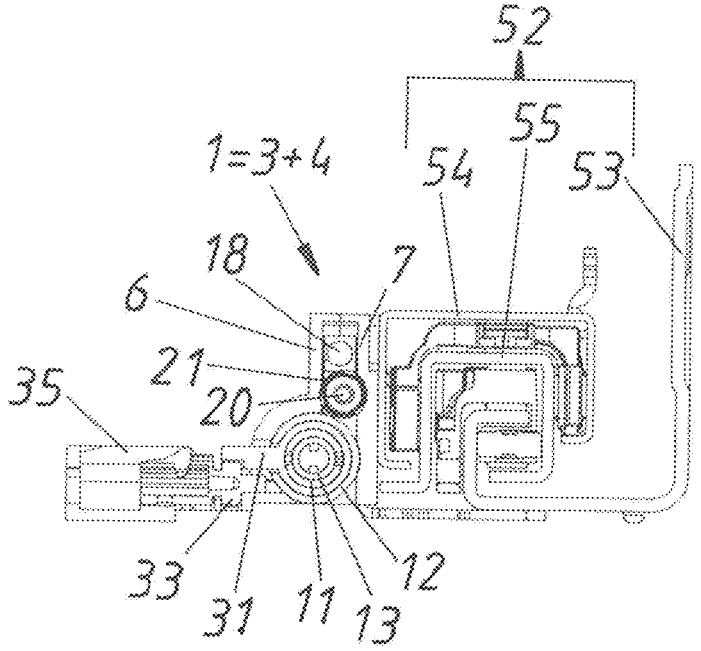
FIGS. 4*a* and 4*b* show a sectional view and a front view of FIG. 3, FIGS. 5*a* and 5*b* show a sectional view and a front view of a drive device according to the prior art.

FIG. 4*a* shows a sectional view through the drive device 1 and the extension guide 52 in the region of the synchronizing rod holder 35. It can be seen herein that the extension guide 52 for a full extension also comprises a central rail 55 besides the carcass rail 53 and the drawer rail 53. It is substantial that the ejection device 3 as well as the retraction device 4 is incorporated in a single housing, wherein this housing comprises the housing cover 6 and the housing base plate 7 (The remaining reference signs will be still explained in the later drawings.). In principle, the housing can also be formed in one piece. The single components do not have to be completely enclosed by the housing. Hence, the housing can clearly only be formed in the form of a base plate on which the components are held. Preferably, the housing is formed in two pieces and substantially completely encloses the single components. By this one housing, in which the ejection device 3 as well as the retraction device 4 is arranged, an easier and faster mounting of the drive device 1 is possible.

Figure 5A:
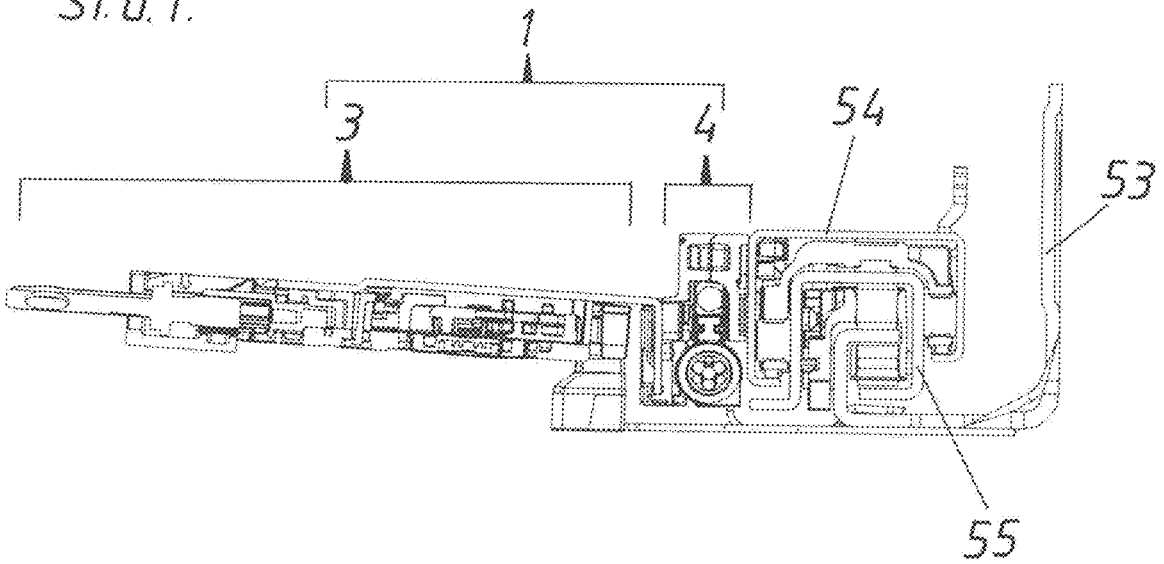

In contrast, FIG. 5*a* shows the prior art as currently produced and sold by the applicant. It can be seen at a first glance that the two substantial components of the drive device 1—namely the ejection device 3 and also the retraction device 4—are formed and arranged separate from each other. This means, the retraction device 4 is mounted to the drawer rail 54 via a separate housing, while the ejection device 3 is attached to the retraction device 4 (or also to the not shown bottom side of the movable furniture part 2) also via a separate housing. A separate entrainment member (not shown here) has to be available for the ejection device 3 as well as for the retraction device 4.

Figure 4B:
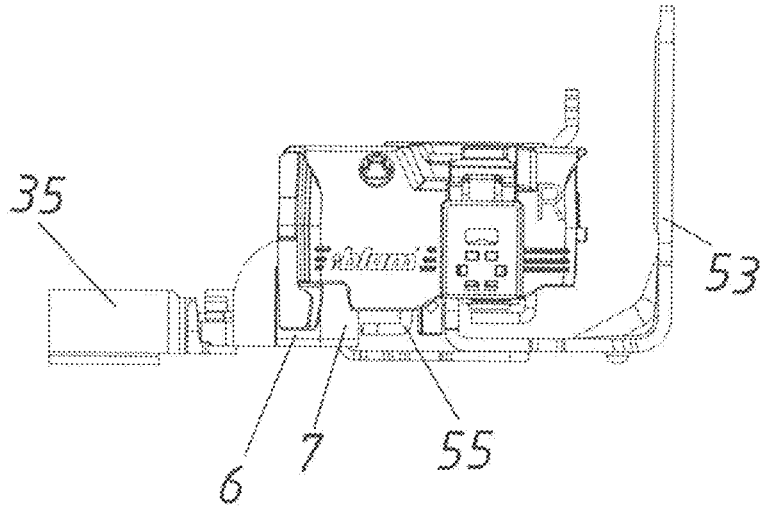
Figure 5B:
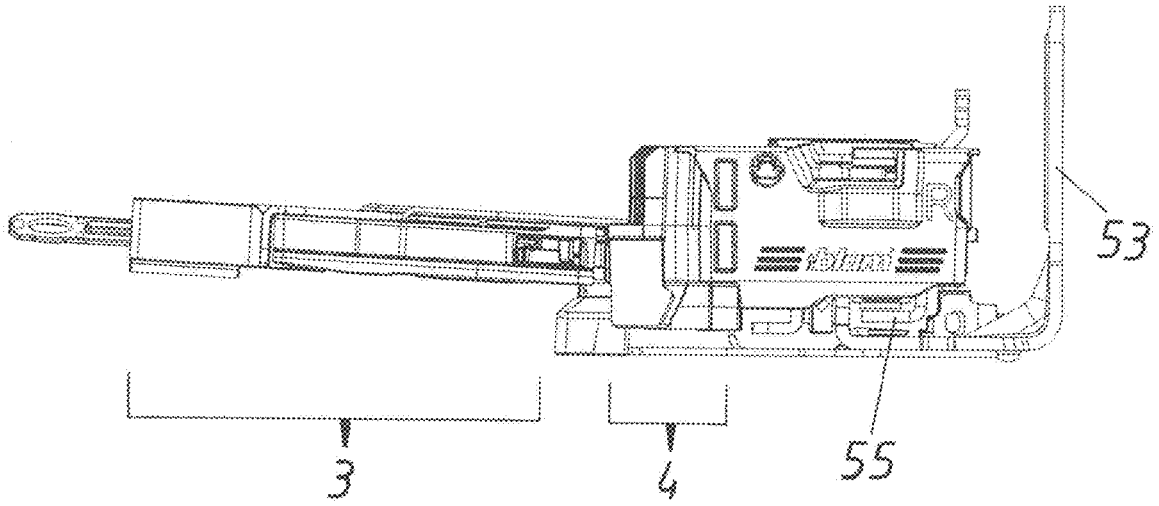

FIGS. 4*b* and 5*b* each correspond to the previously mentioned FIGS. 4*a* and 5*a*, wherein both drawings show front views of the respective drive device.

Figure 6:
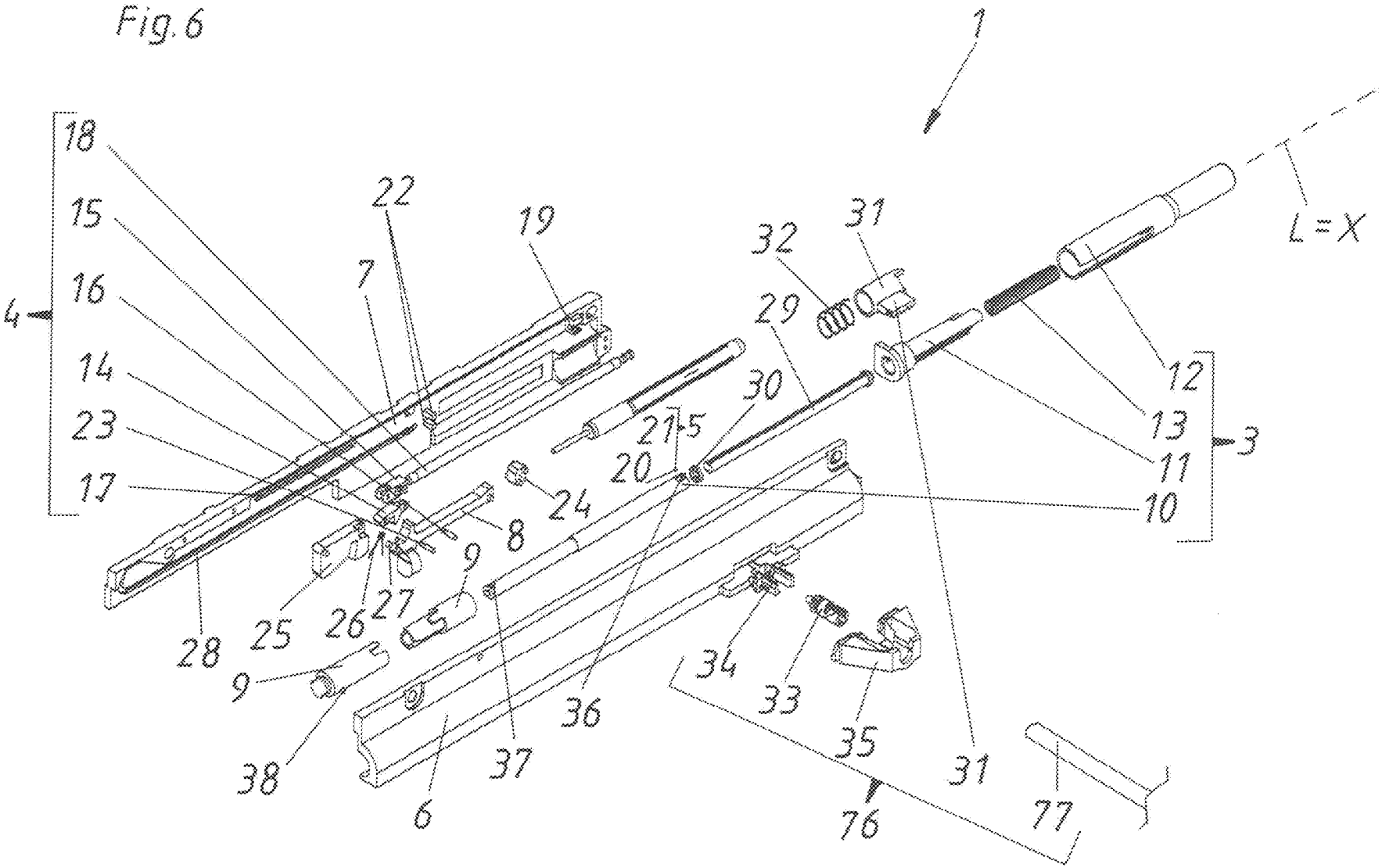
FIGS. 6 and 7 show exploded views of the drive device from different viewing angles.
Figure 7:
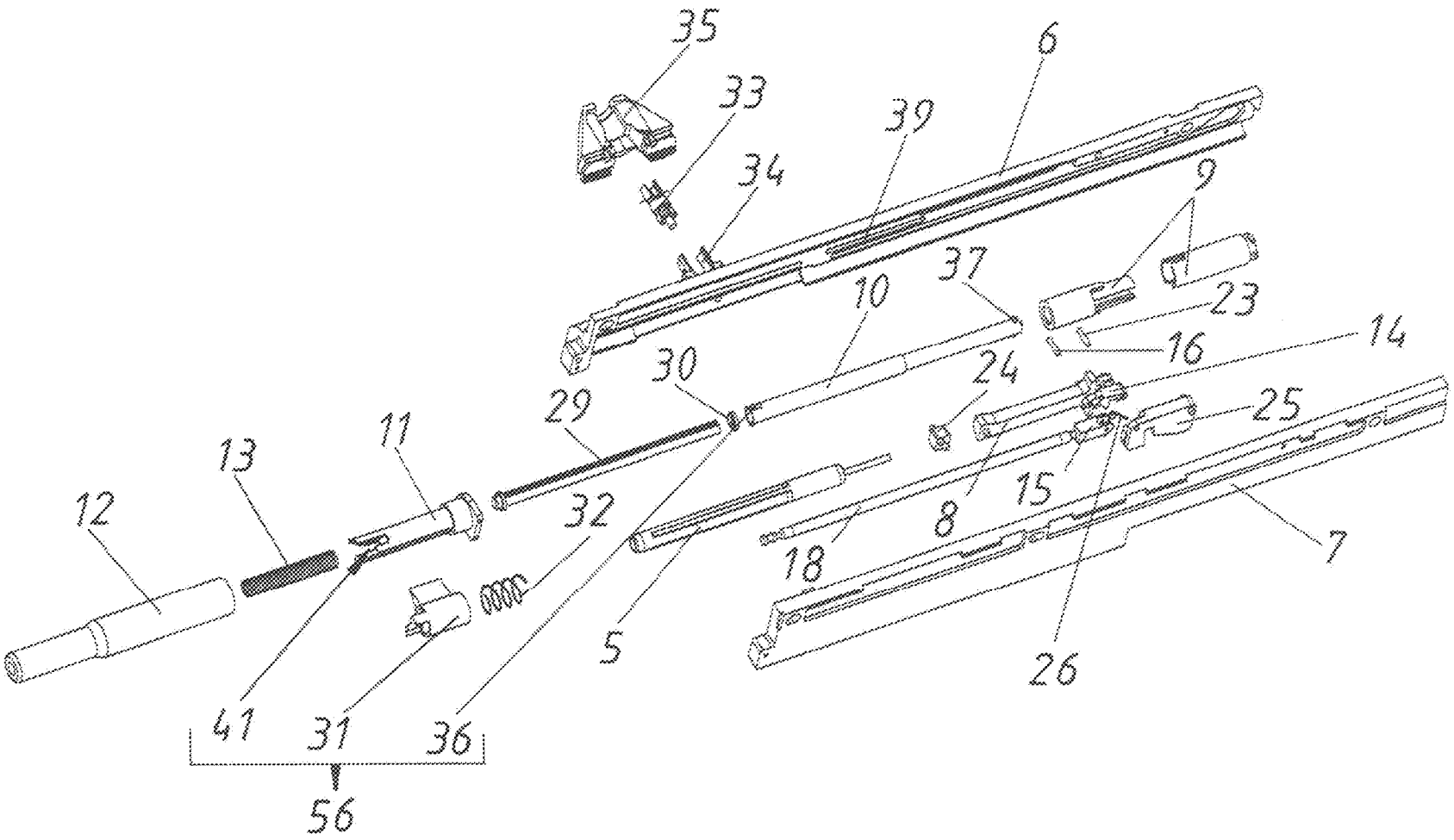

The substantial components of the drive device 1 are described in the following with reference to the FIGS. 6 and 7. This drive device 1 comprises the housing cover 6 and the housing base plate 7 as the two enclosing elements connected to each other. In principle, also more components could of course form the housing, however, it is provided for a simple production and a production as little complex as possible that there are only exactly two housing parts. The drive device 1 can be mounted to the drawer rail 54 by means of the housing base plate 7.

The two main components of the ejection device 3 (also referred to as TIP-ON mechanism or touch-latch-mechanism) are the ejection force storage member 23 as well as the ejection slider 10 which are movable along a longitudinal axis L. In this case, the ejection force storage member 13 is formed as a compression spring. Basically, this ejection force storage member 13 and also the ejection slider 10 could be directly attached to the housing or to a housing part. In this case, a separate ejection housing is provided which is designed in the form of an inner ejection housing 11 and an outer ejection housing 12. The two other components (ejection force storage member 13 and ejection slider 10) are at least partly guided in these ejection housing parts. A guiding bolt 29 is provided in order to maintain the positioning of the ejection force storage member 13 as exact as possible. Moreover, the separating element 30 is guided via a groove (in the guiding bolt 29) and a projection (on the separating element 30) on this guiding bolt 29. This separating element 30 in the form of a washer serves to prevent a direct torque transmission between the ejection force storage member 13 and the ejection slider 10 in the case of a rotation of the ejection slider 10 about the rotational axis X oriented parallel to the longitudinal axis L and because of the torsion of the ejection force storage member 13. A locking pin 36 is arranged on the end of the ejection slider 10 facing the ejection force storage member 13. This locking pin 36 together with the cardioid-shaped locking guide track 41 formed in the ejection housing 11, 12 and together with a locking element 58 integrally formed with the synchronizing coupling piece 31 (see FIG. 9) forms a locking device 56 for the ejection device 3.

For the basic function it would be sufficient if the locking guide track 41 would be stationarily formed in this ejection housing 11, 12. A synchronizing coupling piece 31 is provided for a simple synchronization with the second drive device 1 arranged on the other side of the movable furniture part 2. This synchronizing coupling piece 31 is movable in longitudinal direction L relative to the ejection housing 11, 12. This synchronizing coupling piece is actuated by the synchronizing force storage member 32 (in this case a compression spring). This synchronizing piece 31 can be connected to the synchronizing coupling counter piece 33 in a movement transmitting manner. The synchronizing coupling counter piece 33 is movably, preferably rotationally, supported in the synchronizing guide 34 of the housing. Concretely, a gear rack is formed on the synchronizing coupling piece 31 which meshes with a gear wheel formed on the synchronizing coupling counter piece 33. A synchronizing rod 77 can be attached to the synchronizing coupling counter piece 33. A synchronizing rod holder 35 is provided for a secure mounting. For the functional principle of this whole synchronizing device it can be exemplarily referred to the WO 2015/051386 A1.

Further, the drive device 1 comprises a retraction device 4. The substantial parts of this retraction device 4 are the retraction force storage member 18, the retraction slider 15, the retraction latch 14 and the retraction locking track 17. The retraction force storage member 18 is on the one side attached to the ejection force storage member base 19 of the housing base plate 7 and on the other hand attached to the retraction slider 15. In principle, the retraction slider 15 can be directly lockable in an angled end section of the retraction locking track 17. In this case, however, it is provided that the retraction latch 15 is pivotally supported on the retraction slider 15 by means of the retraction connecting pin 16, whereby the whole retraction slider 15 is lockable in a retraction locking position in an angled end section of the retraction locking track 17 by means of a retraction locking pin 23 attached to the retraction latch 14. The retraction force storage member 18 is formed as a tension spring which moves the retraction slider 15 to the right according to the illustration in FIG. 6 when relaxing.

This retraction movement per se can be carried out only by the force of the retraction force storage member 18. However, in order to enable a soft retracting, the drive device 1 also comprises a damping device 5 for the retraction device 4. For that purpose, the damping device 5 comprises a damping cylinder 21 and a damping piston 20 guided in the damping cylinder 21. The damping cylinder 21 is held between the housing cover 6 and housing base plate 7. The damping piston 20 is guided by the damping piston guide 22. During its movement path, this damping piston 20 partially acts onto the intermediate piece 24. This intermediate piece 24 is movably supported in a limited manner in the intermediate piece guide track 39 via corresponding guiding projections.

The drive device 1 further comprises a push element 8 and a coupling element 9 in order to enable that the retraction device 4 as well as the ejection device 3 can be incorporated in a single housing 7, 6. The coupling element 9 is shown in two pieces in the illustrations according to FIGS. 6 and 7. This, however, is only advantageous because of manufacturing reasons. Otherwise, this coupling element 9 can also be formed in one piece. The push element 8, in turn, is slidably supported in the guide track 28 via corresponding projections. Also the catch hook 25 is guided in the guide track 28. Moreover, the catch hook 25 is rotatably supported on the push element 8 by means of the catch hook rotary bearing 27. Further, the catch hook force storage member 26 (in the form of a leg spring) is arranged between the catch hook 25 and the push element 28. The catch hook force storage member 26 guarantees a secure locking of the catch hook 25 in the angled end section of the guide track 28. For a compact construction it is provided that the housing 6, 7 of the drive device 1, the coupling element 9 and the ejection slider 10 (carrier) are at least partly formed sleeve-shaped or cylindrical. In particular, the ejection housing 11, 12 together with the locking guide track 41 formed therein, the coupling element 9 together with the coupling track 45 formed therein and the housing 6, 7 together with the control track 40 formed therein are cylindrically formed, wherein the locking guide track 41, the coupling track 45 and the control track 40 each are formed on a, preferably inward facing, cylinder jacket surface vaulted about the rotational axis X.

Figure 8:
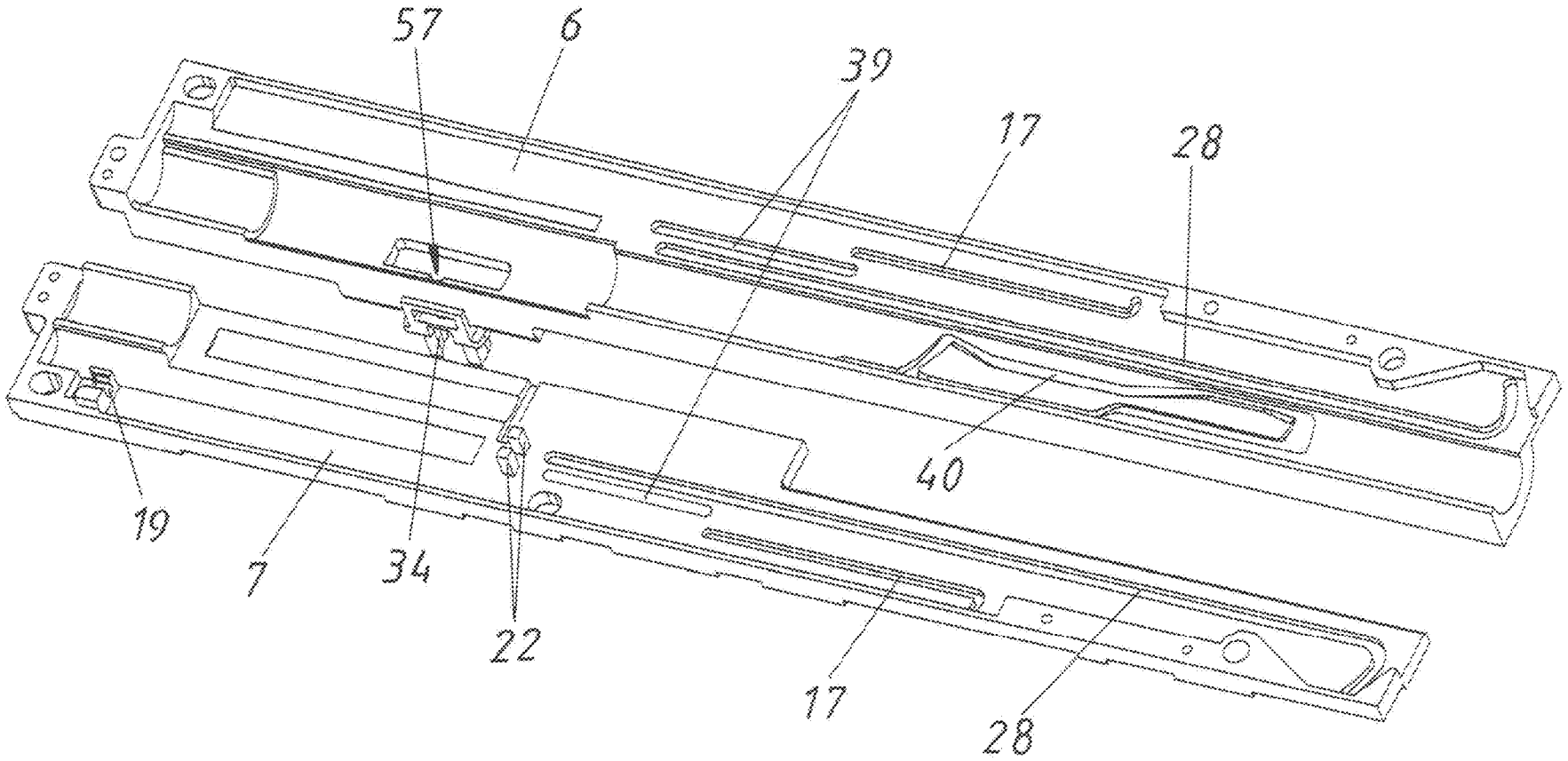
FIG. 8 shows the two housing part of the drive device with internal details.

FIG. 8 shows the housing cover 6 and the housing base plate 7 in an unfolded state so that the details formed therein are better visible. The retraction locking guide tracks 17 for the retraction latch 14, the guide tracks 28 for the catch hook 25 and the push element 8 as well as the intermediate piece guide track 39 are each mirror-symmetrically formed in the two housing parts 6 and 7. In contrast, the retraction force storage member base 19 and the damping piston guide 22 are formed in or on the housing base plate 7. Moreover, the synchronizing guide 34 as well as the opening 57 can be seen on or in the housing cover 6. The synchronizing coupling piece 34 projects from the housing through this opening 57.

Figure 9:
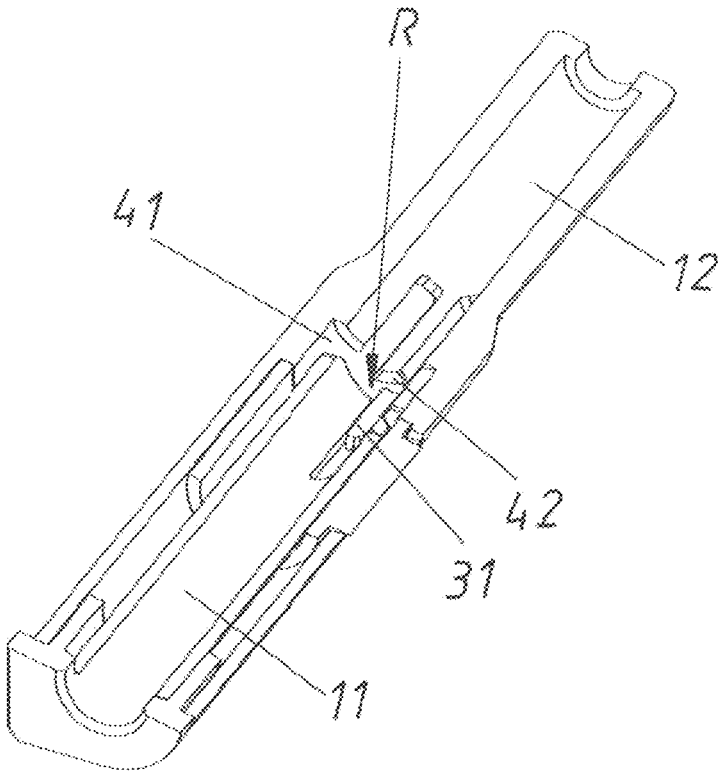
FIGS. 9 to 11 show the ejection housing and the synchronizing counter piece in different positions and different viewing angles.
Figure 9:
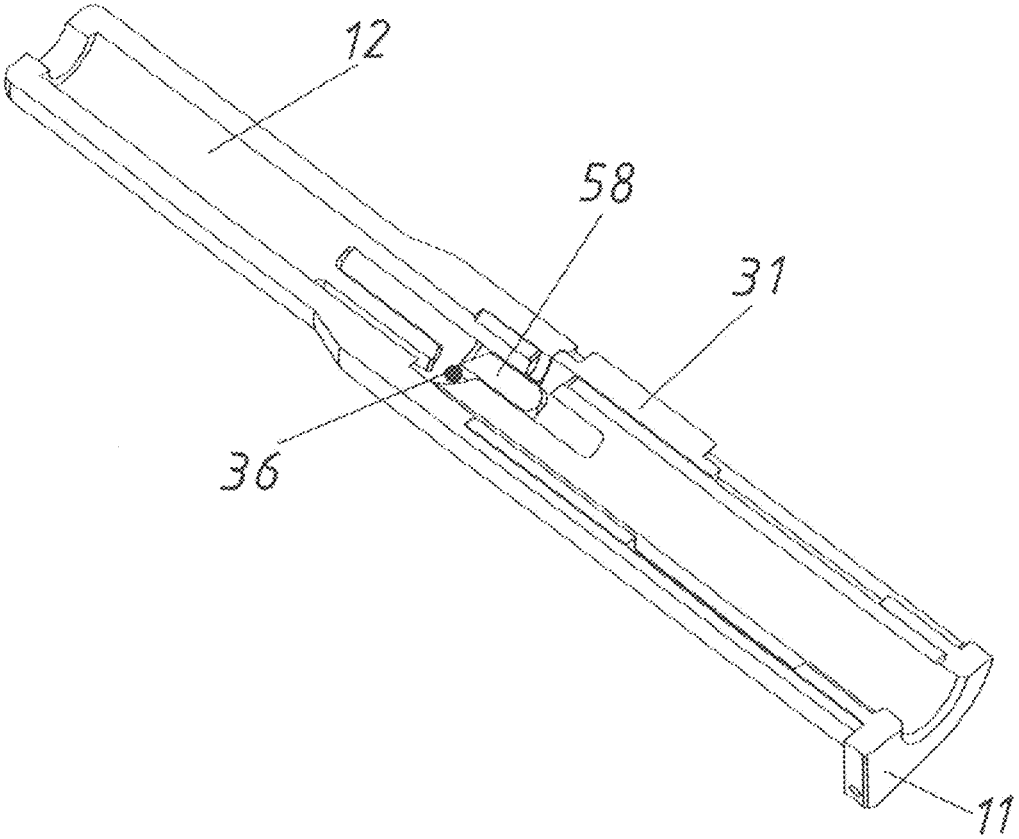

FIG. 9 in a two different perspectives shows an insight of an ejection housing 11, 12 cut in half. It can be determined that parts of the locking guide track 41 for the locking pin 36 are formed in the inner ejection housing 11 as well as in the outer ejection housing 12. In addition, the latch recess R is partly formed by the inner ejection housing 11 and partly formed by the locking element 58. The locking pin 36 is schematically shown in the lower illustration of FIG. 9 when this locking pin 36 is locked in the latch recess R.

Figure 10:
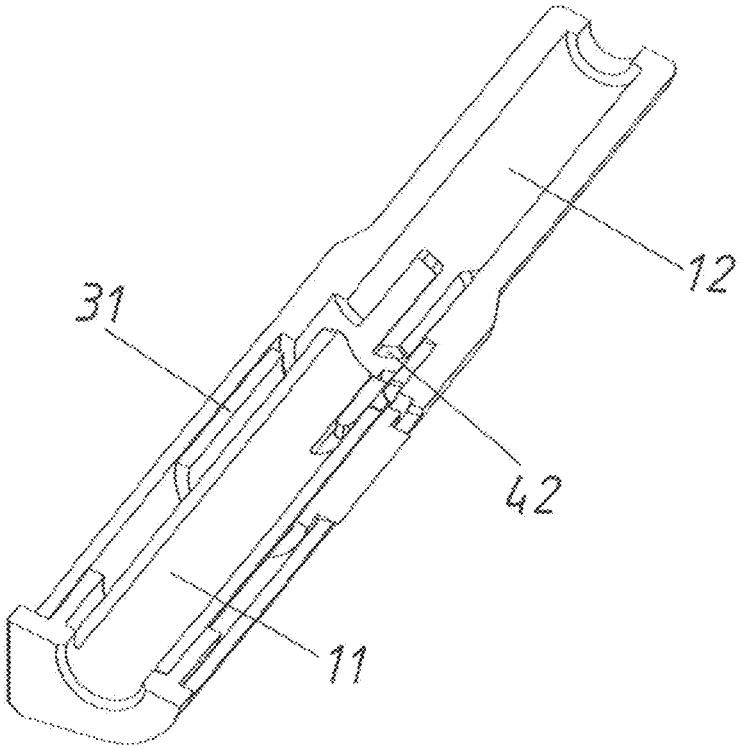
Figure 10:
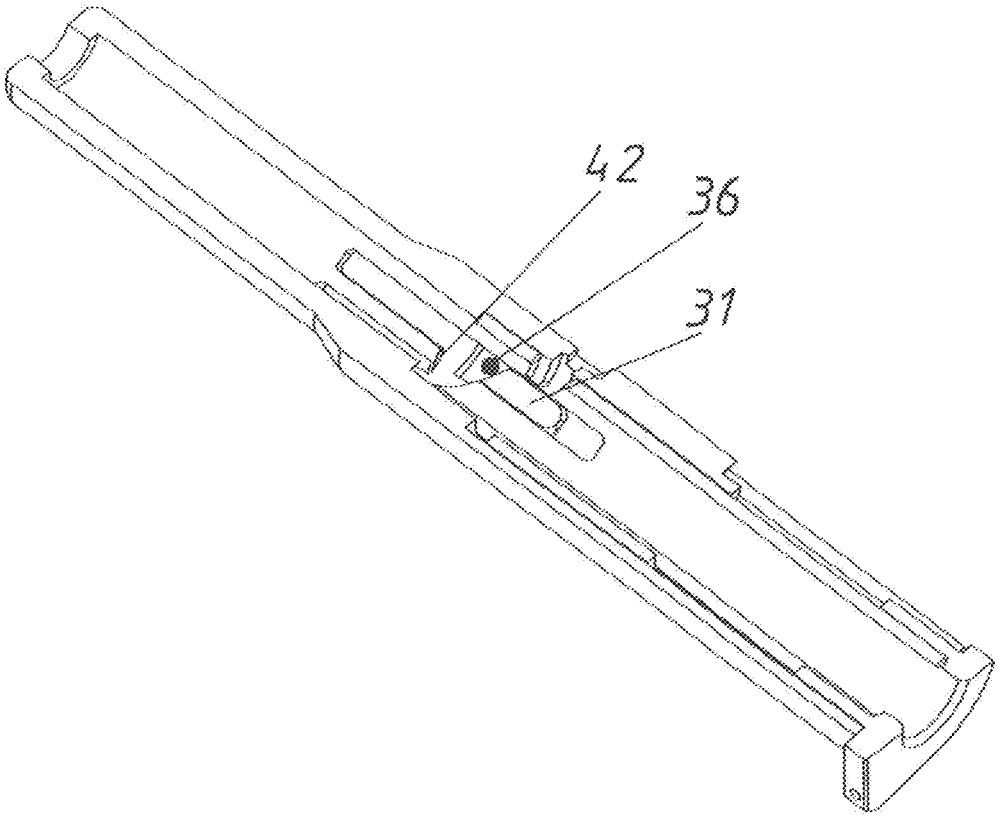

In the case of an unlocking of the locking device 56 by over-pressing the movable furniture part 2 in closing direction SR, the locking pin 36 is moved in the direction of the deflection slope 42 and is deflected by this deflection slope 42 so that the locking pin 36 reaches an ejection section of the locking guide track 41. After releasing the movable furniture part 2 the locking pin 36 contacts the locking element 58 on a front side (see FIG. 10), whereby the force of the ejection force storage member 13 ejects the ejection slider 10 together with the locking pin 36 attached thereon in opening direction OR.

Figure 11:
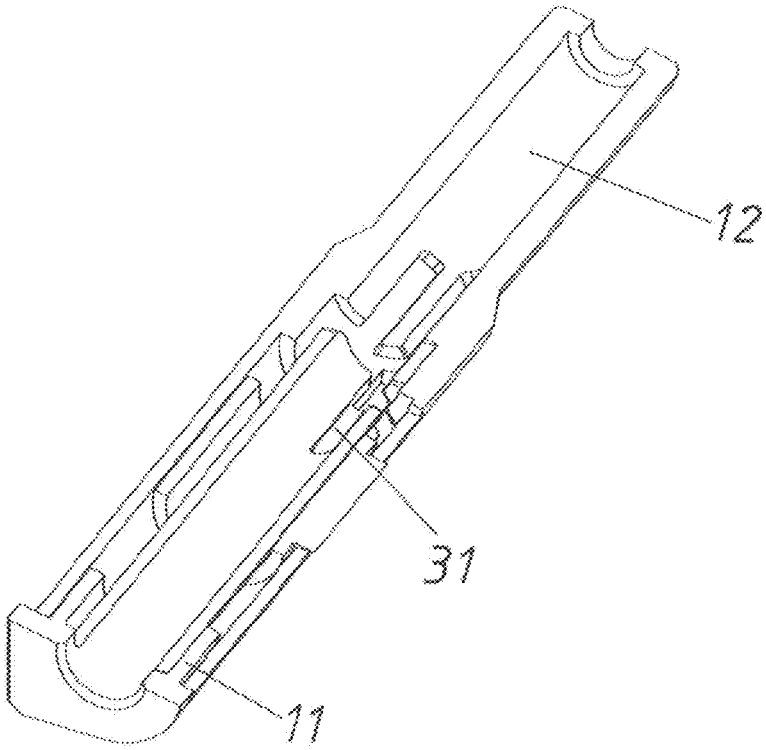
Figure 11:
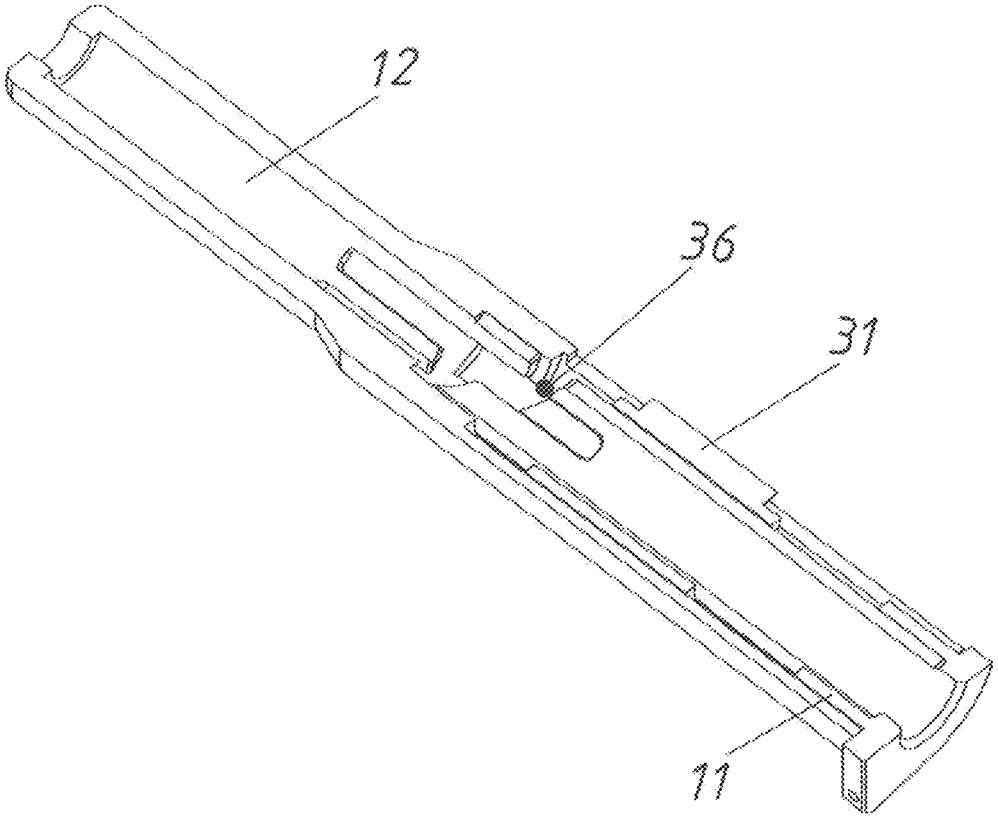

Subsequently, the locking element 58—which is integrally formed with the synchronizing coupling piece 31—is further moved in opening direction OR until the position according to FIG. 11 is reached. In this position the locking pin 36 is just deflected again by an inclined surface in the ejection section of the locking guide track 41 (see lower illustration of FIG. 11).

Figure 12:
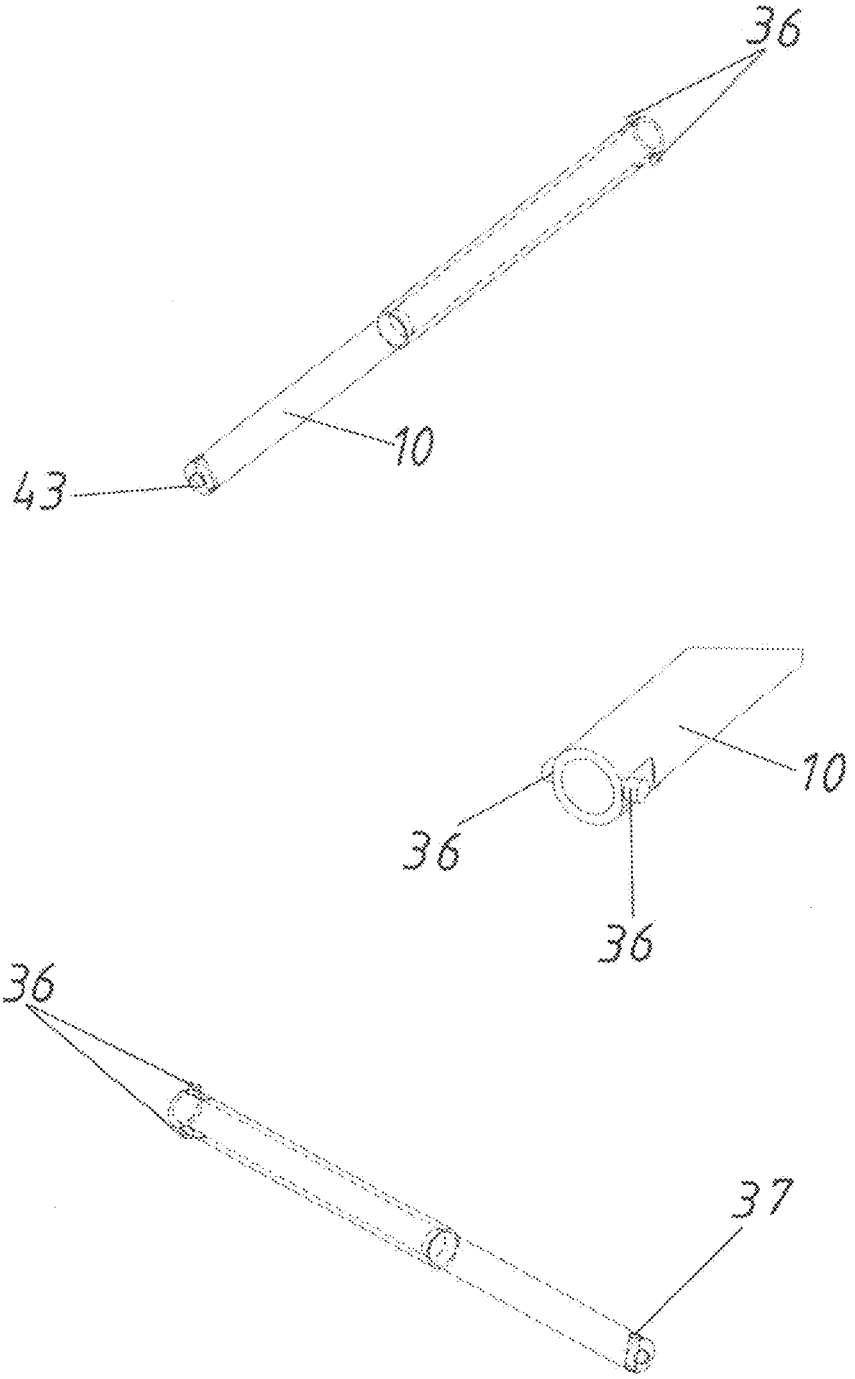
FIG. 12 shows details of the ejection slider.
Figure 13A:
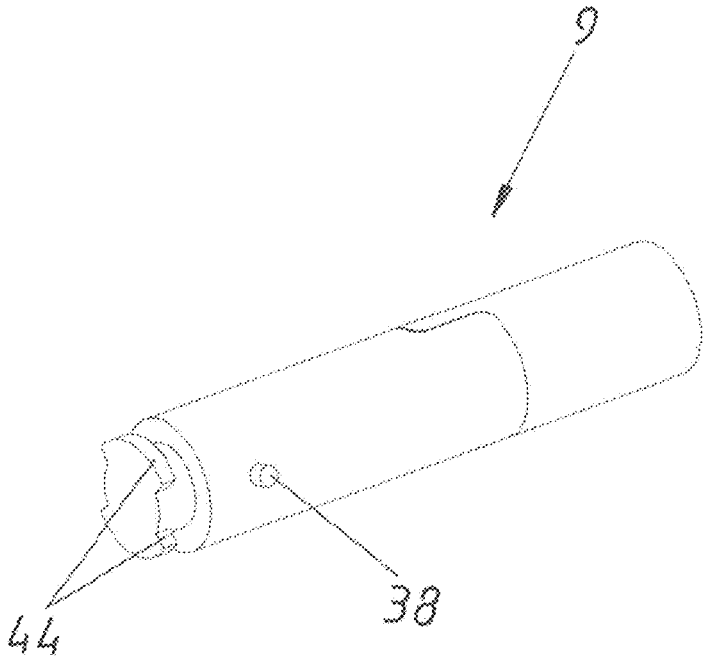
FIGS. 13*a* to 13*d* show different views and section of the coupling element.
Figure 13B:
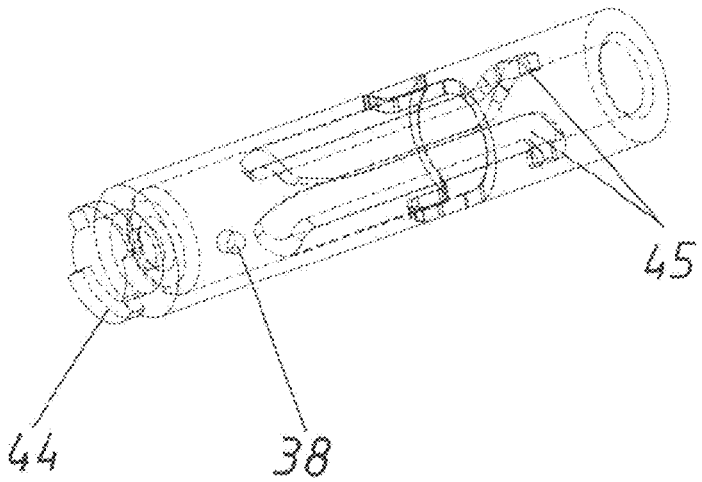
Figure 13C:
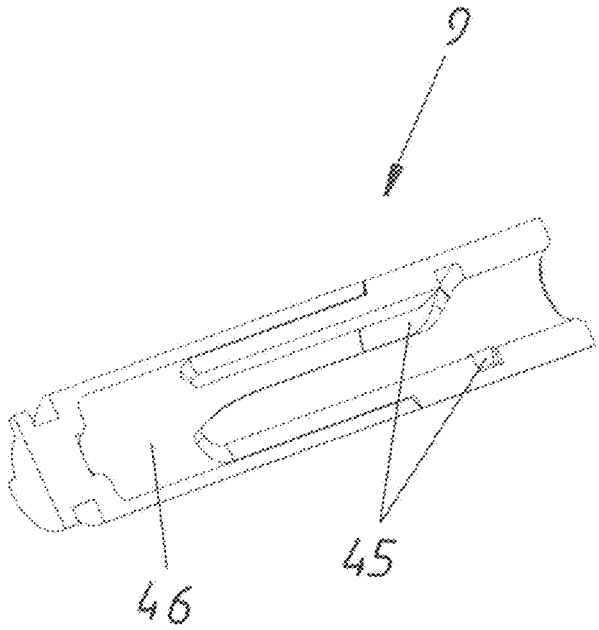
Figure 13D:
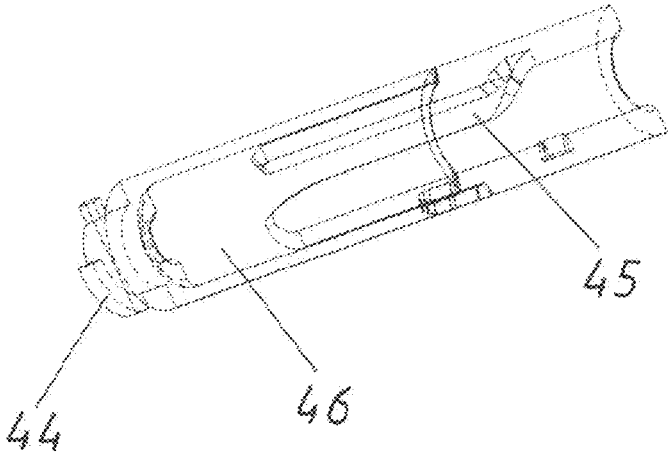

FIG. 12 illustrates in different views that the ejection slider 10 comprises two opposite locking pins 36 on its end directed towards the ejection force storage member 13. A hemisphere-shaped abutment 43 is provided on the end remote from the ejection force storage member 13. This abutment 43 serves for minimizing the torque between the touching parts (ejection slider 10 and coupling element 9). On this end, moreover, a recess is provided in which a coupling pin 37 (not shown here) can be attached.

FIGS. 13*a* to 13*d* still show different, partly cut or partly transparent views of the sleeve-shaped coupling element 9. The control pin 38 is formed on the coupling element 9. In addition, the bajonet-like coupling parts 44 are provided on a top end. In the interior of these coupling elements 9—this means on the inward cylinder jacket surface—two identical coupling tracks 45 are formed. The coupling tracks 45 are shifted to each other by 180°. These coupling tracks 45 comprise a continuous freewheel section 46 for the coupling pin 37 arranged on the ejection slider 10.

Figure 14:
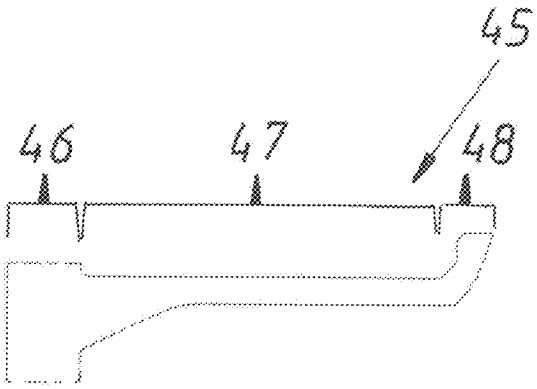
FIG. 14 shows the coupling track projected onto a straight surface.

Such a coupling track 45 is illustrated in FIG. 14. This coupling track 45 comprises the three sections freewheel section 46, guiding and idling section 47 as well as holding section 48. The coupling pin 37 is movable in this coupling track 45.

Figure 15:
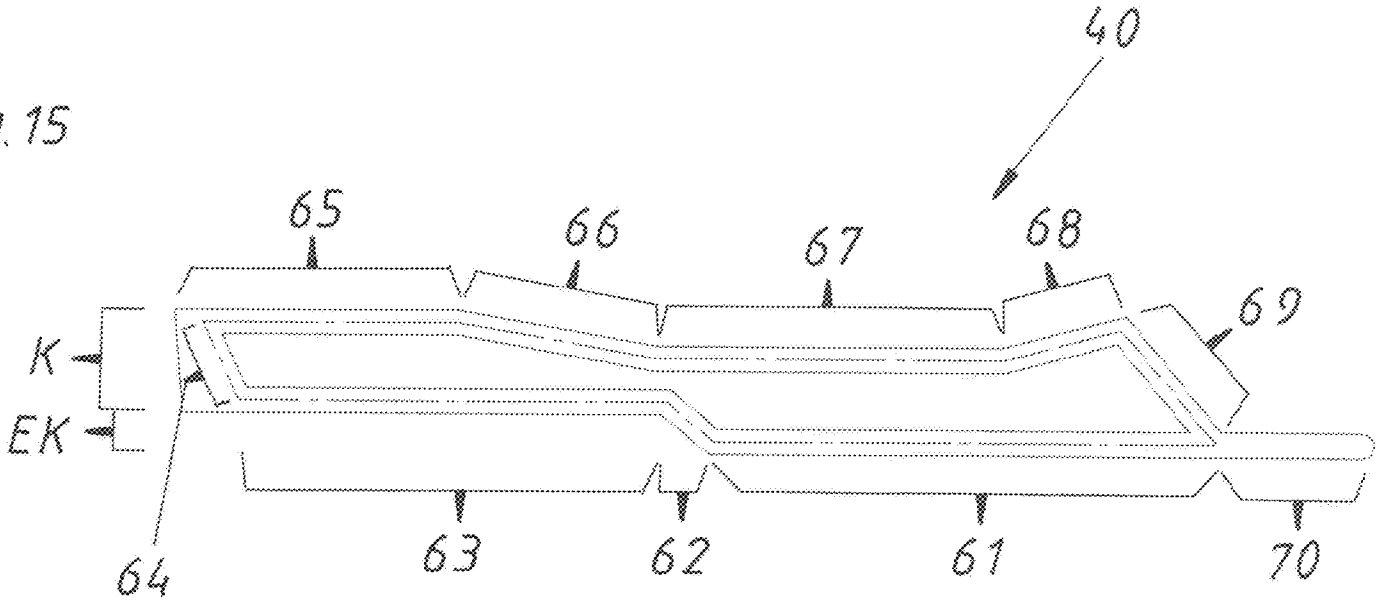
FIG. 15 shows the control track projected onto a straight surface.

In contrast, FIG. 15 shows the control track 40 formed on a cylinder-jacket-shaped inner side of the housing cover 6 projected onto a flat surface. The control pin 38 arranged on the coupling element 9 moves in this control track 40. Depending on the position of the control pin 38 in the control track 40, the coupling element 9 is coupled by means of the bajonet-like coupling parts 44 with the push element 8 (coupling region K) or uncoupled (uncoupling region EK). In addition, also the relative movements of the coupling element 9 and the ejection slider 10 to each other about the rotational axis X oriented parallel to the longitudinal direction L is controlled by this control track 40. These entire control movements are demonstrated in the movement sequence of the whole drive device 1 illustrated and explained in more details in the following FIGS. 16 to 31.

Figure 16:
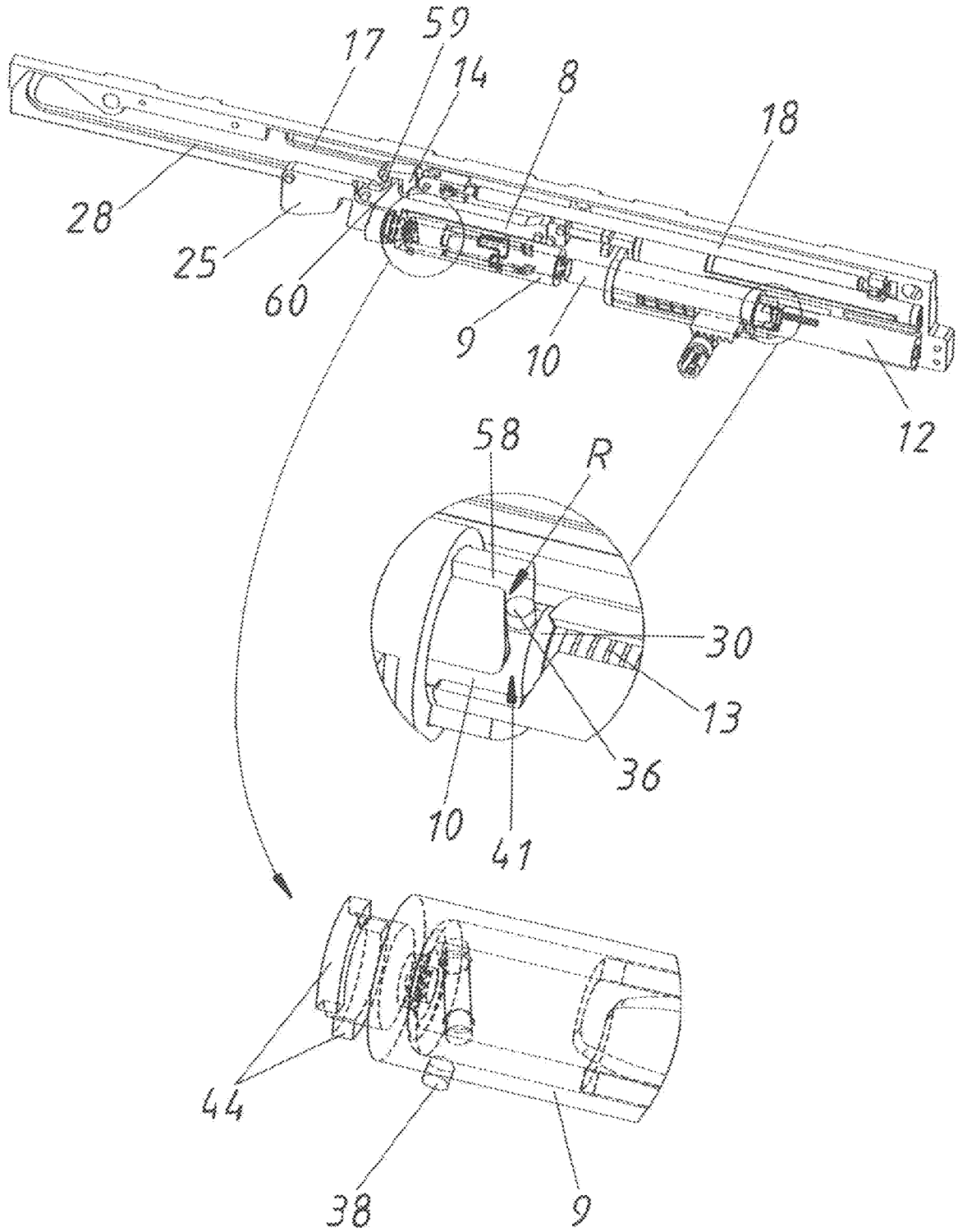
FIGS. 16 to 31 show different positions of the movement sequence of the drive device with several details and FIGS. 32 to 34 show views and details of exceptional positions.

Referring to FIG. 16 it shall initially be noted that the drive device 1 is illustrated in an assembled state without the housing cover 6. Moreover, the single components are illustrated partially transparent (see dashed line). In FIG. 16 the movable furniture part 2 is in a closed position SS. In addition, the locking device 56 is in a locking position VS as the locking pin 36 (see the upper detail) is locked in the latch recess R of the locking guide track 41. The ejection force storage member 13 presses via the separating element 30 onto the locking pin 36 arranged on the ejection slider 10, so that the locking pin 36 cannot be moved relative to the inner ejection housing 11 (which in fact is fixedly connected to the housing 6, 7). The locking element 58 formed by the synchronizing coupling piece 31 is jointly forming the latch recess R of the locking guide track 41. In the lower detail of FIG. 16, moreover, the end region of the coupling element 9 with the bajonet-like coupling parts 44 is illustrated. In the closed position SS the coupling element 9 is not coupled to the push element 8. Further, FIG. 15 shows that the retraction force storage member 18 is not tensioned. The retraction latch 14 contacts the push nose 60 of the push element 8 with its catch section 59.

Figure 17:
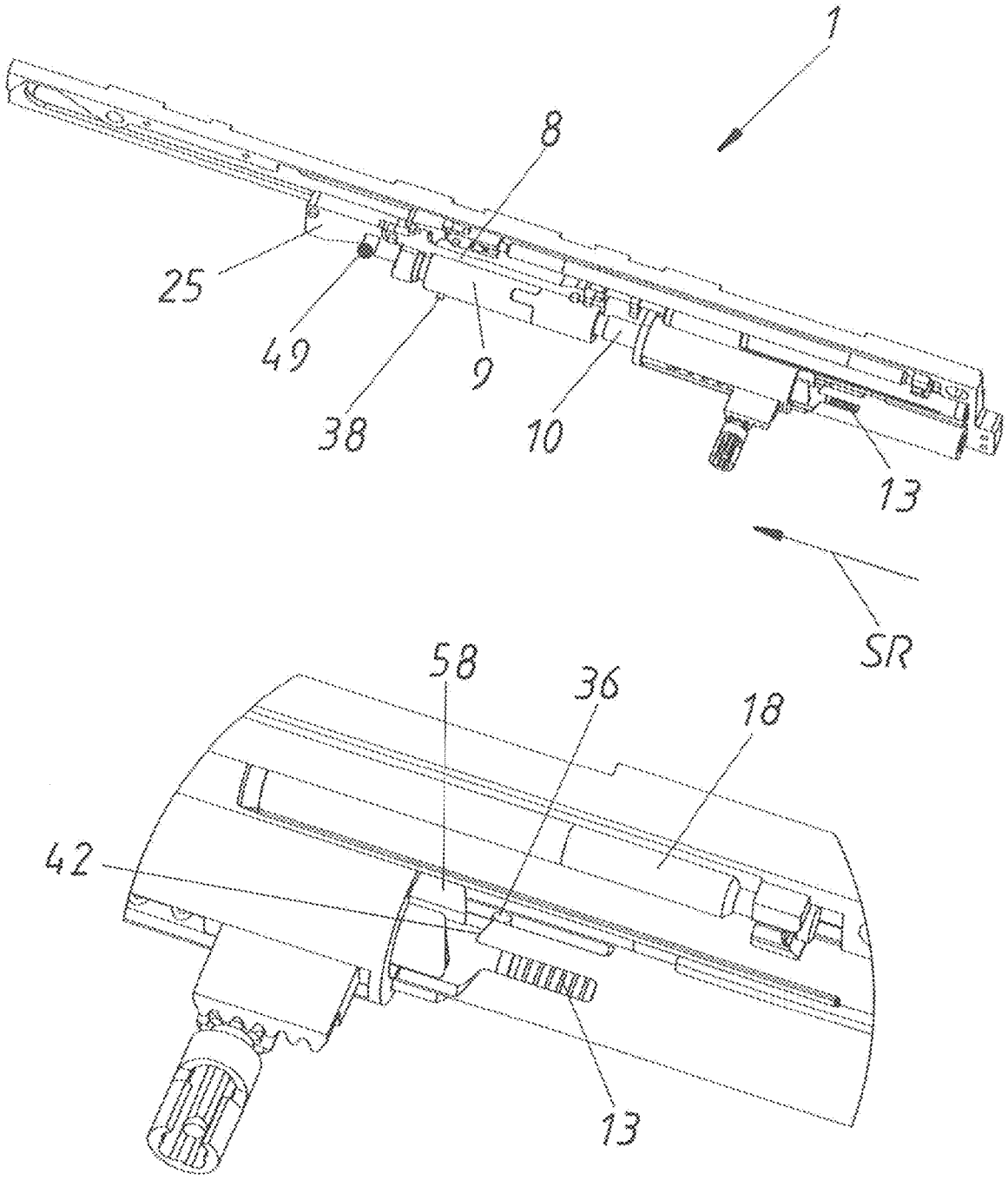

If now pressing in closing direction SR onto the movable furniture part 2 starting from the closed position SS according to FIG. 16, the unlocking is carried out as illustrated in FIG. 17. Thereby, the second operating mode B2 of the drive device 1 is initiated. As in the preferred embodiment the drive device 1 is arranged on the movable furniture part 2, the housing 6, 7 of the drive device 1 is moved in closing direction SR (in FIG. 17 to the left). As, however, the catch hook 25 is abuts the schematically illustrated entrainment member 49 fixed to the furniture carcass 51, the ejection slider 10 abutting the coupling element 9 is moved—by means of the catch hook 25, by means of the push element 8 connected to the catch hook 25 and by means of the coupling element 9 abutting the push element 8—relative to the remaining components of the drive device 1 against the force of the ejection force storage member 13 until the locking pin 36 abuts the deflection slope 42 of the locking guide track 41 and via this deflection slope 42 reaches the position according to FIG. 17 in the ejection section of the locking guide track 41. Thereby, the locking device 56 is no longer in the locking position 56 but is rather unlocked (unlocking position ES). The over-pressing path is about 1 to 3 mm. If the housing 6, 7 is not arranged on the movable furniture part 2 but rather on the furniture carcass 51, in principle the same relative movement between the single components of the drive device 1 is carried out when over-pressing. In that case, however,—in contrast to the arrow SR in FIG. 17—the ejection slider 10 is moved to the right in the closing direction SR by the moved entrainment member 49 arranged on the movable furniture part 2.

Figure 18:
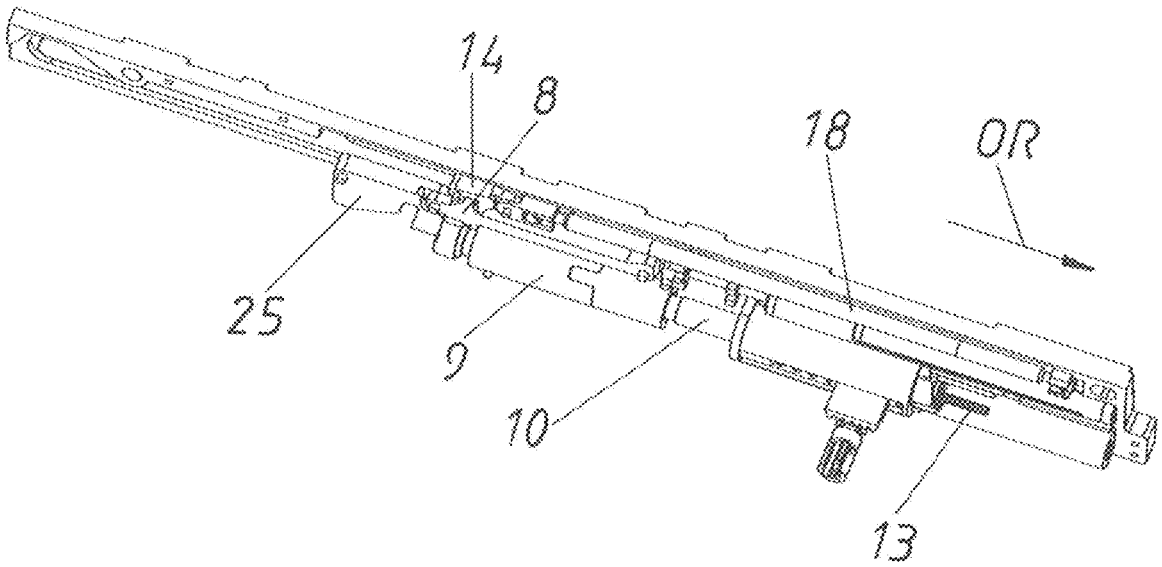
Figure 18:
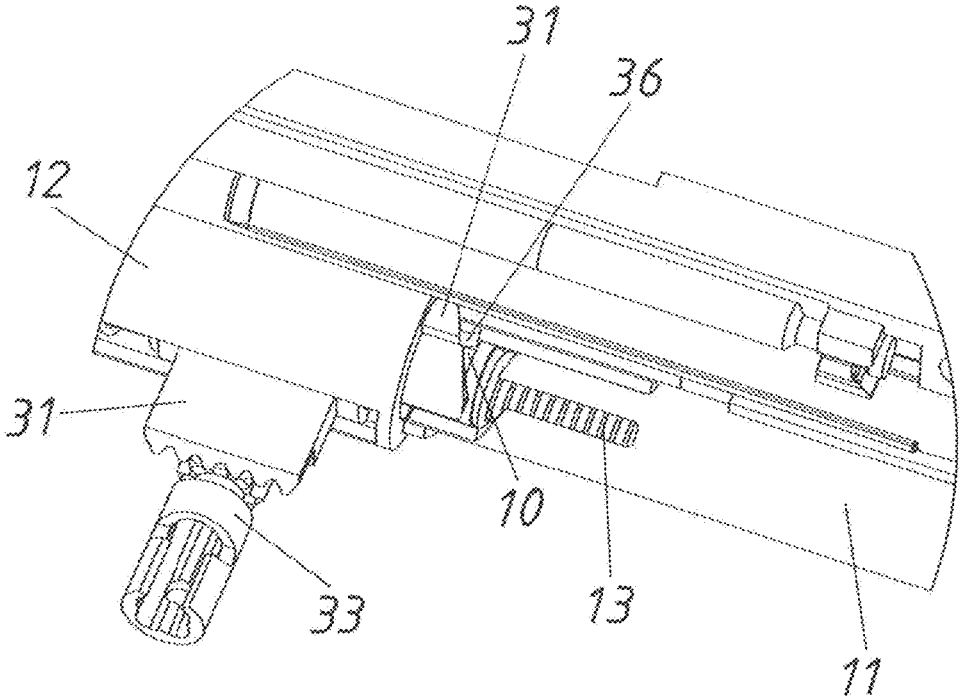

If then, starting from the over-pressing position ÜS, the movable furniture part 2 is no longer pressed, the ejection force storage member 13 can start to relax according to FIG. 18. This relaxing ejection force storage member 13 thereby presses onto the ejection slider 10, whereby the locking pin 36 abuts the front face of the locking element 58 of the synchronizing coupling piece 31. As a consequence, the whole synchronizing coupling piece 31 is moved relative to the ejection housing 11, 12. By this movement also the gear rack of the synchronizing coupling piece 31 meshes with the gear wheel of the synchronizing coupling counter piece 33 (see detail of FIG. 18). Thus, also in the drive device arranged on the other side of the movable furniture part 2 (not shown) an unlocking is triggered (see still later FIG. 33). By the beginning relaxation of the ejection force storage member 13 also the housing 6, 7 is moved relative to the ejection element 10, to the coupling element 9, to the push element 8 and to the catch hook 25 in opening direction OR. As the push element 8 entrains the retraction latch 14 via the push nose 60, also the tensioning of the retraction force storage member 18 begins. Therefore, the spring force of the ejection force storage member 13 is larger than the spring force of the retraction force storage member 18. For explanation in each of the FIGS. 16 to 18 part sections, especially of the outer ejection housing 12, are partly hidden so that a better insight into the interior of the ejection housing 11, 12 is possible.

Figure 19:
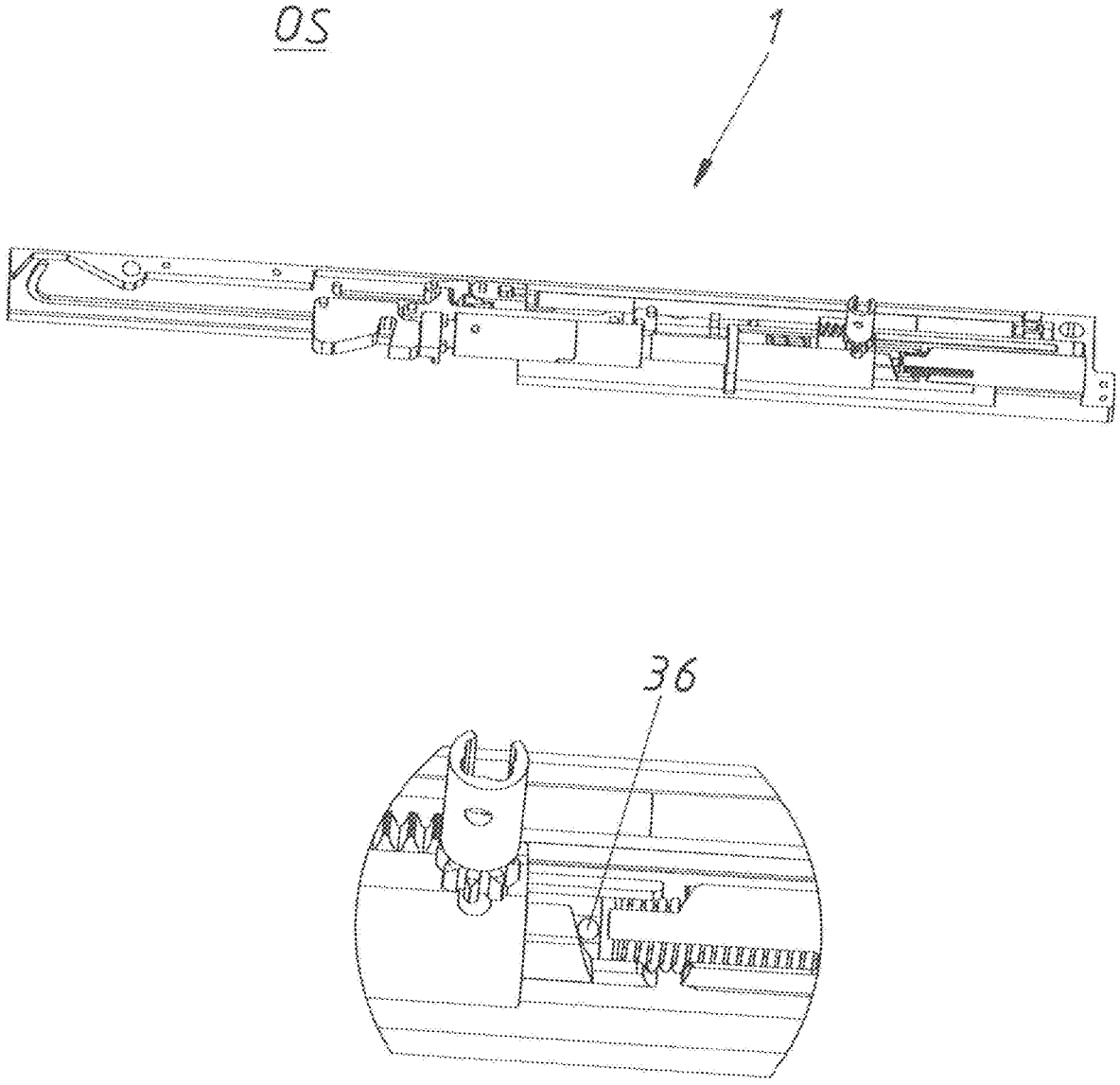

According to FIG. 19 the movable furniture part 2 has been still further ejected and a first slight open position OS is reached. Because of the design of the locking guide track 41 in the outer ejection housing 12—as can be seen in the detailed view from below—the locking pin 36 is further deflected so that this locking pin 36 is evading the locking element 58 (see also FIG. 11). As the locking pin 36 in this position also no longer presses onto the synchronizing coupling piece 31, the synchronizing force storage member 32 can relax and moves the synchronizing coupling piece 31 again into the position e.g. according to FIG. 16.

Figure 20:
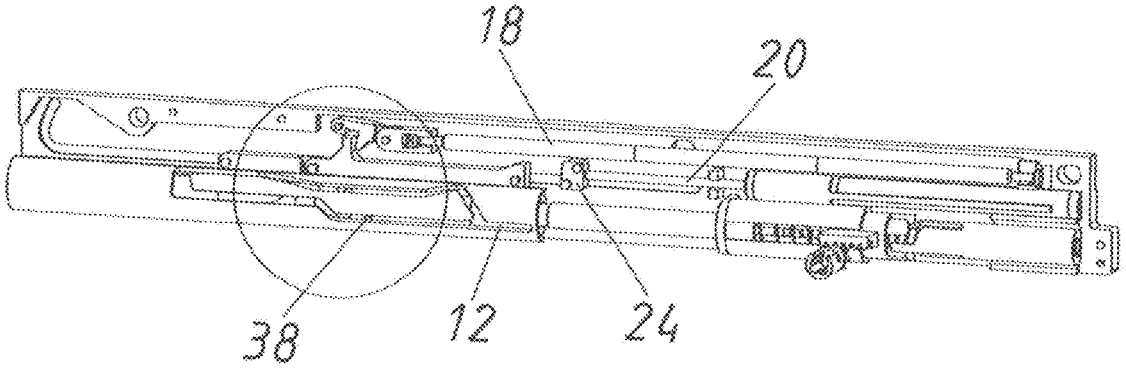
Figure 20:
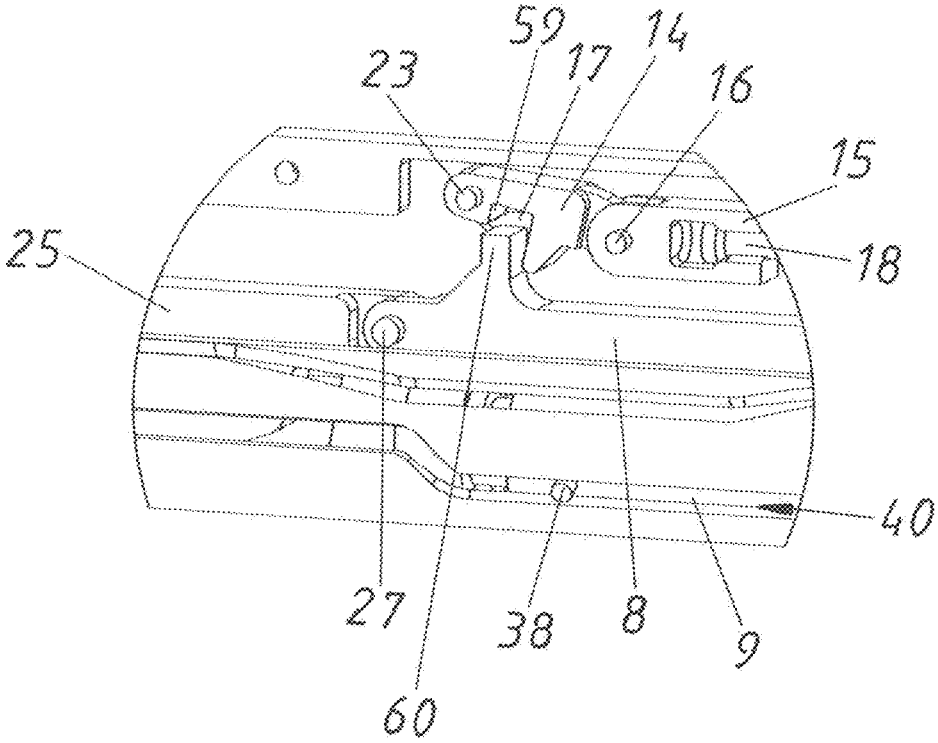

In FIG. 20 the ejection or opening movement has further continued. The ejection force storage member 13 is relaxed already for a large part, at least so far that the retraction force storage member 18 is fully tensioned. In this fully tensioned position of the retraction force storage member 18 the retraction latch 14 has been pivoted about the retraction connecting pin 16 relative to the retraction slider 15 so that the retraction locking pin 23 is locked in the angled end section of the retraction locking track 17 (see detail of FIG. 20). By this pivoting movement also the push nose 60 of the push element 8 no longer abuts in the catch section 59 of the retraction latch 14. In this FIG. 20 it is also recognizable that the intermediate piece 24 has reached an end abutment of the intermediate piece guide track 39 because of the trail movement of the damping piston 20. Further, it is particular important to mention in connection with FIG. 20 (as also with the following drawings) that the housing cover 6 is partly unhidden. This housing cover 6 is cut or unhidden so far that in the remaining illustrated housing cover 6 the control track 40 exactly remains. This illustration only serves for demonstrative reasons. Thus, it can be seen in FIG. 20 that the control pin 38 on the coupling element 9 has already traveled a significant part of the ejection control track section 61 (see also FIG. 15).

In each upper entire view of the FIGS. 21 to 31 an outer region of the housing cover 6 is hidden so that the position of the control pin 38 in the control track 40 is well visible in the remaining inner region of the housing cover 6. In the lower entire views of these FIGS. 21 to 31 this housing cover 6 is completely hidden. Instead, an outer region of the coupling element 9 is hidden each so that the position of the coupling pin 37 in the coupling track 45 is well visible in the remaining inner region of the coupling element 9. Therebetween, always details of each above shown entire view is illustrated.

Figure 21:
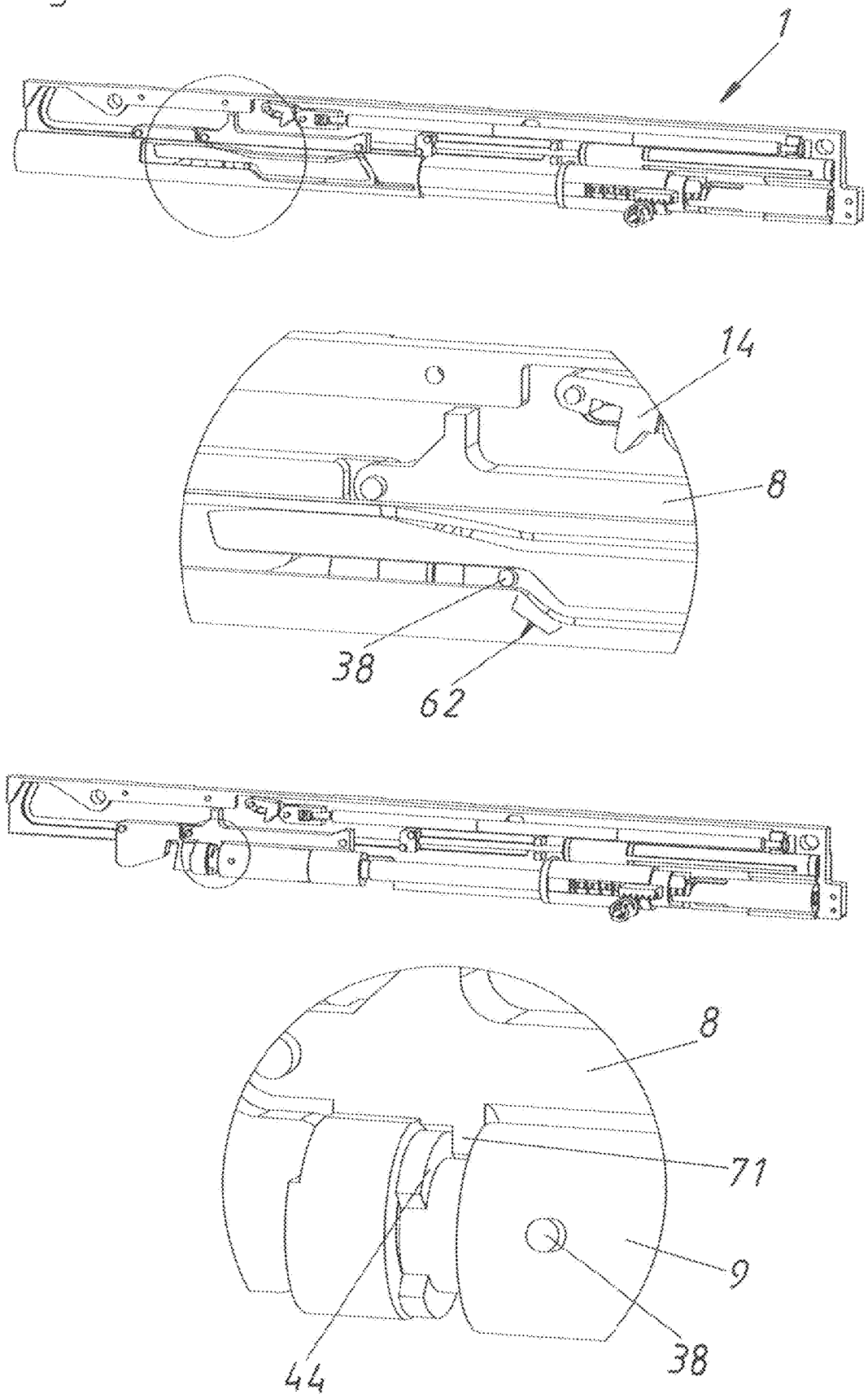

According to FIG. 21 the ejection force storage member 13 has fully relaxed. As a consequence, in the upper detail of FIG. 21 it is visible on the one hand that the push element 8 has still further moved away from the retraction latch 14 of the tensioned retraction device 4. On the other hand the control pin 38 has moved through the coupling control track section 62 of the control track 40. As a consequence, a rotational movement of the coupling element 9 relative to the housing cover 6 is triggered, whereby the bajonet-like coupling part 44 of the coupling element 9—as shown in the lower detail of FIG. 21—couples on a projection 71 formed on the push element 8. Thereby, the uncoupling position EK is no longer given, but rather the coupling position K between the push element 8 and the coupling element 9 is reached. Starting from this position according to FIG. 21 the further opening movement is carried out without an influence by one of the force storage members 13 or 18. The further opening movement can still be effected by the momentum of the force which has been introduced by the ejection force storage member 13 into the movable furniture part 2 or by actively pulling the movable furniture part 2.

Figure 22:
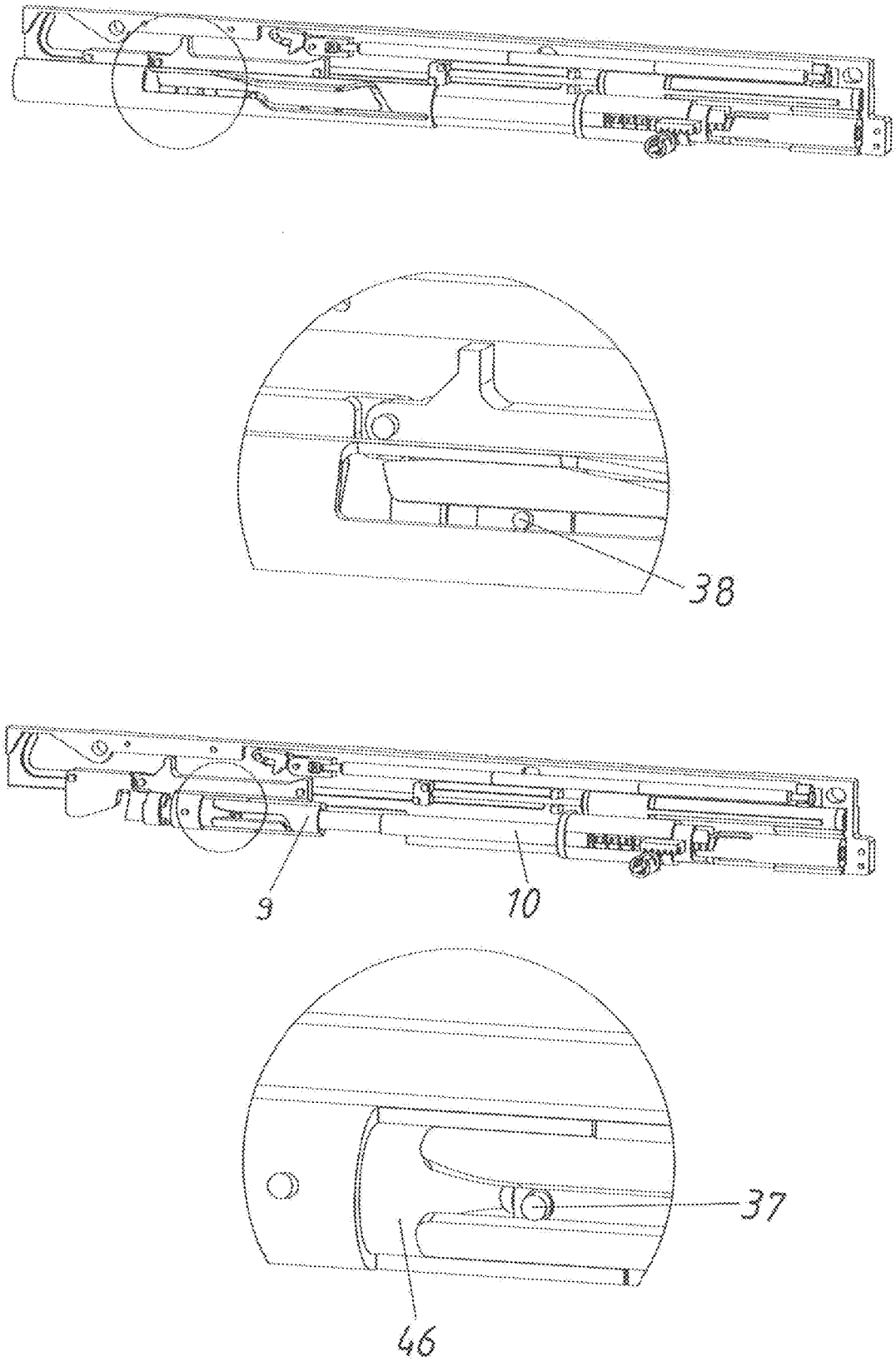

By this further opening movement according to FIG. 22 the control pin 38 is further moved through the shifting control track section 63 of the control track 40. Starting from the position according to FIG. 21 also the ejection slider 10 can no longer be moved further as an end abutment for the locking pin 36 in the ejection housing 11, 12 is reached (not shown). As starting from reaching the coupling position K the coupling element 9 is jointly moved by the push element 8 in the case of a further opening movement, a relative movement of the coupling element 9 to the ejection slider 10 is effected. As a consequence, the coupling pin 37 arranged on the end of the ejection slider 10 remote from the ejection force storage member 13 travels from the freewheel section 46 into the guiding and idling section 47 of the coupling track 45 in the coupling element 9. For explanation in this detail—similar to the housing cover 6 in the upper detail—a radially outer region of the coupling element 9 is hidden so that a direct view onto the remaining coupling track 45 in the coupling element 9 is possible. Also this only serves for demonstration.

Figure 23:
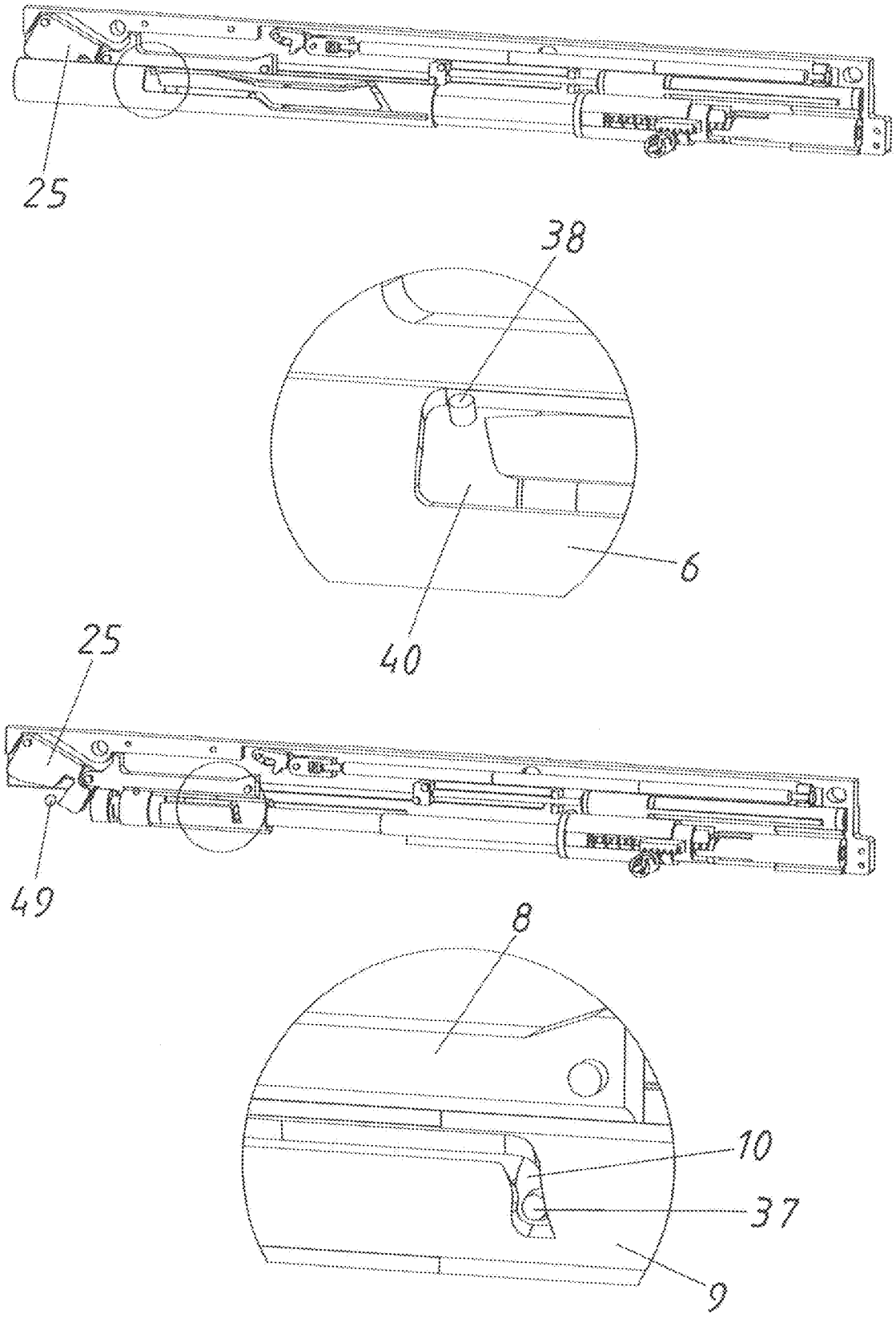

Finally, according to FIG. 23 also the remaining opening path is completed so that the catch hook 25 has been deflected into the angled end section of the guide track 28. The catch hook 25 is held in this position by the catch hook force storage member 26. According to the lower detail of FIG. 23 also the coupling pin 37 on the ejection slider 10 has moved in the angled holding section 48 of the coupling track 45 of the coupling element 9 with this remaining opening movement. By the inclined design of the coupling track 45 in the holding section 48 the coupling element 9 is rotated relative to the ejection element 10. This rotational movement also causes that according to the upper detail of FIG. 23 the control pin 38 has been moved through the redirecting control track section 64 of the control track 40. In FIG. 23 the entrainment member 49 only just has contact to the catch hook 25.

Figure 24:
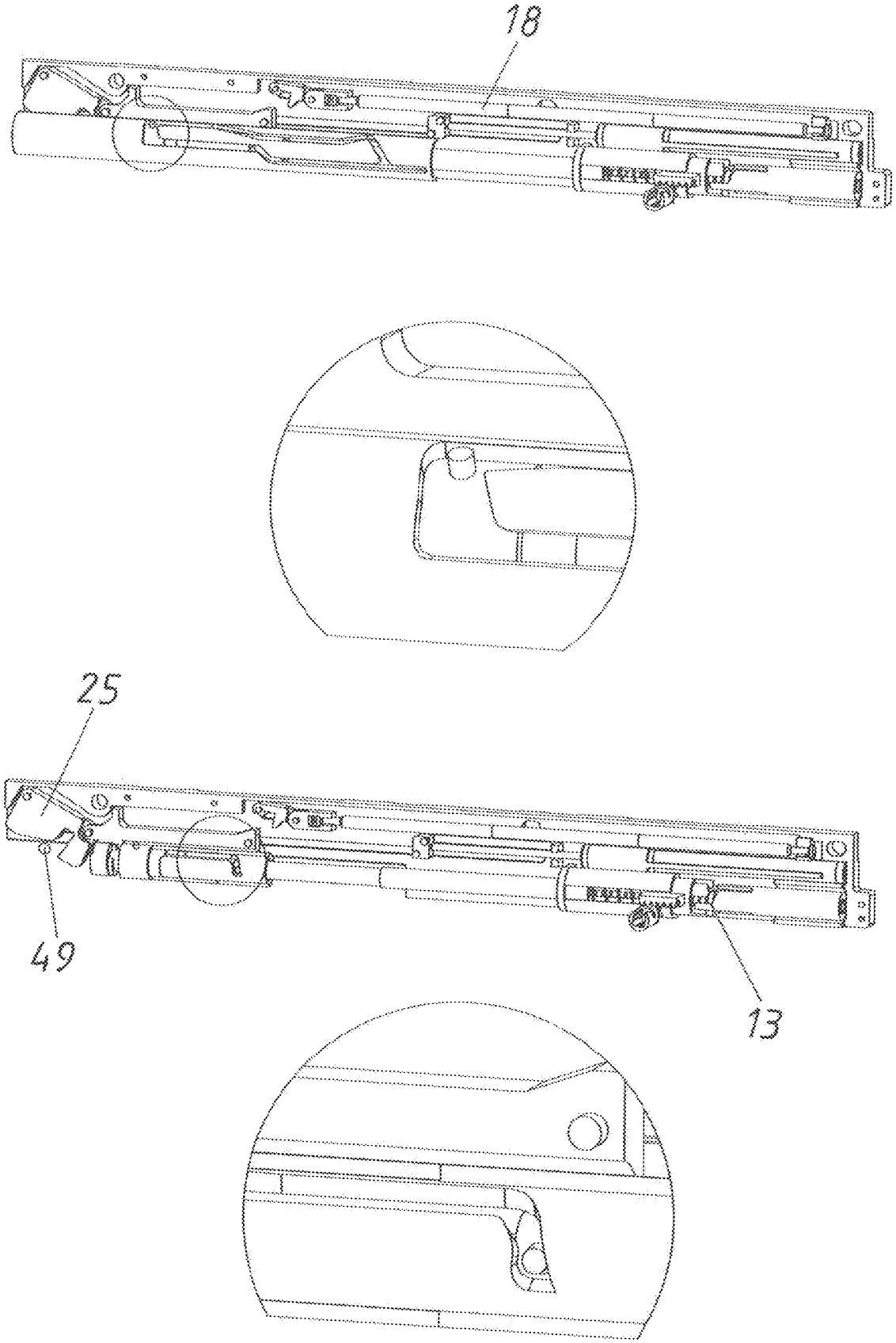

In contrast, in FIG. 24 the entrainment member 49 already has lifted or moved away from the catch hook 25. Thereby, the movable furniture part 2 is in a freewheel. During this freewheel all components of the drive device 1 remain in the position. This means, the retraction force storage member 18 is tensioned and the ejection force storage member 13 is relaxed.

According to FIG. 15 the closing movement of the movable furniture part 2 begins. As the entrainment member 49 is reaching contact with the catch hook 25, the catch hook 25 is released from the angled end section of the guide track 28 against the force of the catch hook force storage member 26. According to FIG. 25 the coupling element 9 has already been displaced slightly to the right by means of the push element 8 abutting the coupling element 9. As the ejection element 10 is actuated by the ejection force storage member 13, the coupling pin 37 touches the holding surface 72 of the control track 45 according to the lower detail of FIG. 25. The holding surface 72 is oriented rectangular to the longitudinal axis L or is formed slightly undercut. As in this case the forces of the coupling element 9 substantially vertically act onto the coupling pin 37, the coupling pin 37 is jointly moved by the coupling element 9 in the case of a further pushing movement. In the case of the pushing movement the control pin 38 is moved through the straight tensioning control track section 65 of the control track 40. This is particularly caused by the fact that the coupling pin 37 is in contact with the undercut holding surface 72.

Figure 25:
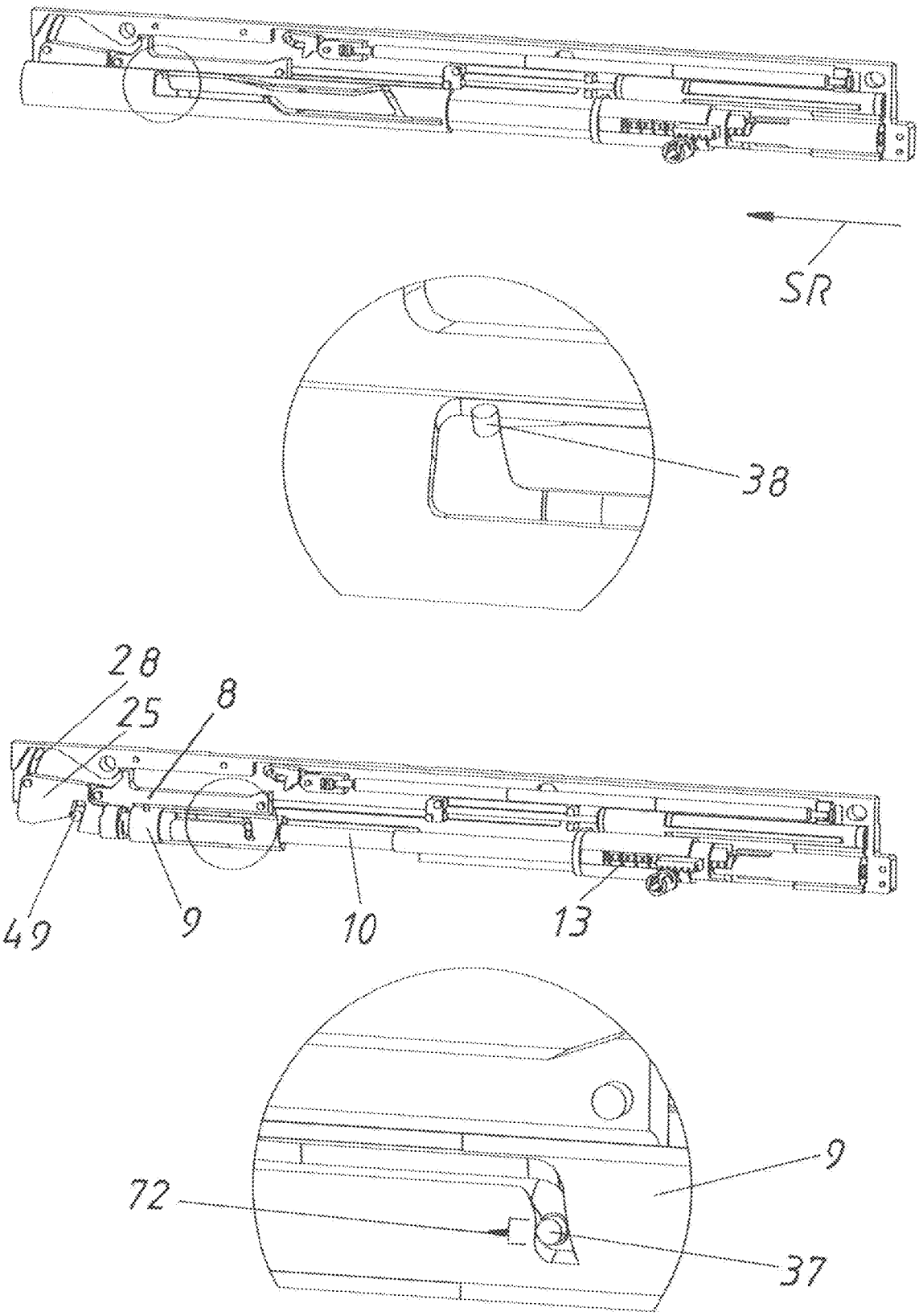
Figure 26:
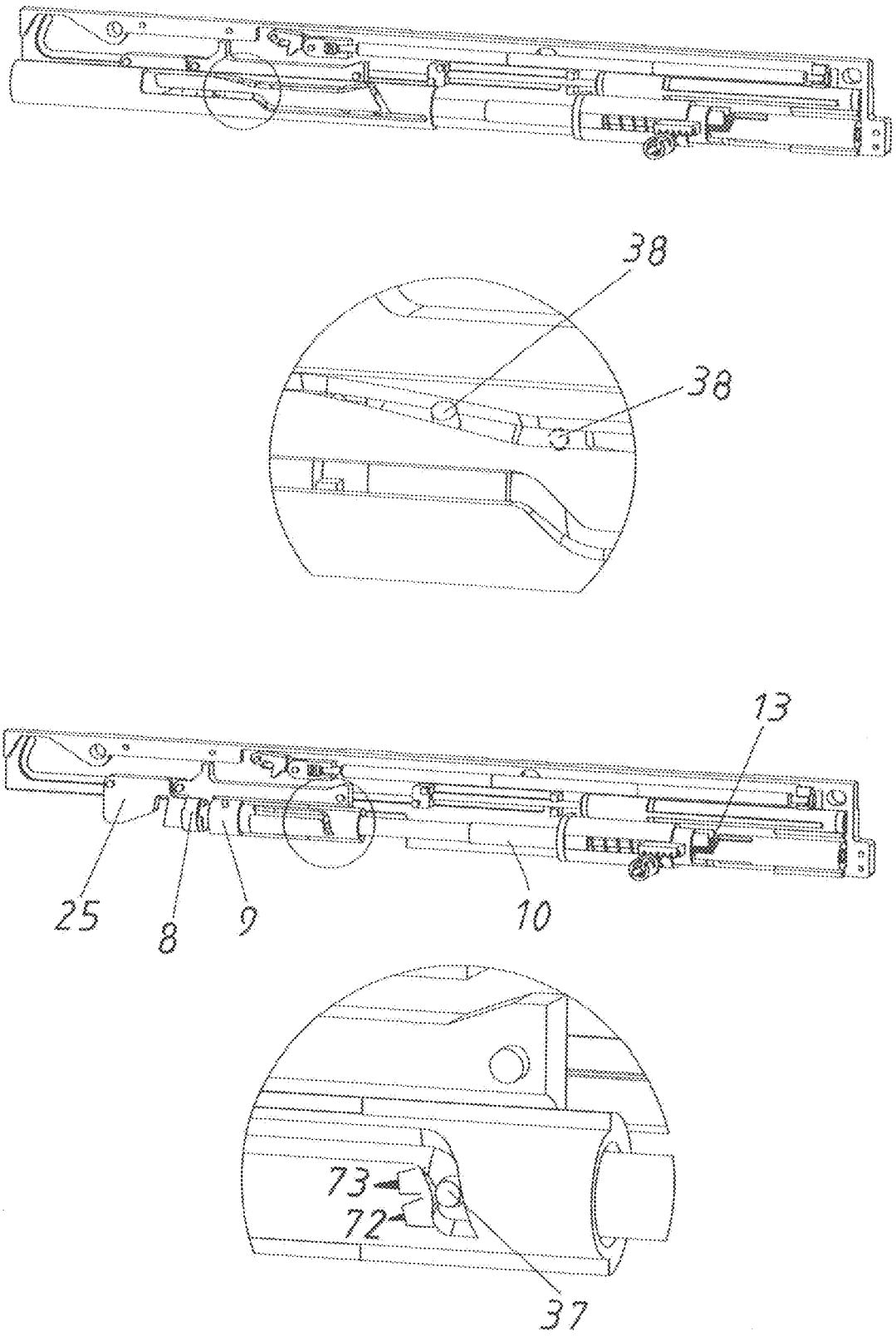

The ejection force storage member 13 is tensioned from the position according to FIG. 25 to the position according to FIG. 26 as the ejection element 10 is moved by means of the catch hook 28, the push element 8 and the coupling element 9 against the force of the ejection force storage member 13 by way of the coupling pin 37 abutting the holding surface 72 of the control track 45. In FIG. 26 the control pin 38 has already traveled a part of the path in the deflection control track section 66 of the control track 40. This deflection control track section 66 causes a rotation of the coupling element 9 relative to the housing cover 6. By this rotation of the coupling element 9 the coupling pin 37 is simultaneously released from the holding surface 72 of the coupling track 45 according to the lower detail of FIG. 26 and reaches an inclined section 73 of the control track 45. In the case of abutting this inclined section 73 the ejection force storage member 13 is still tensioned. Because of the contact to the inclined section 73 the coupling pin 37 wants to evade upwards relative to the inclined section 73 and wants to push the coupling element 9 respectively. However, both movements are not yet possible in the position according to FIG. 26. A further downward movement of the coupling element 9 relative to the coupling pin 37 is indeed possible only so far until the control pin 38 attached to the coupling element 9 abuts the holding control track section 67 of the control track 40. This means, in the position of the control pin 38 indicated in dashed lines in the upper detail of FIG. 26, the relative movement between the housing cover 6 and the coupling element 9 has not yet progressed so far that the coupling pin 37 could come to the guiding and idling section 47 of the coupling track 45. On the other hand, an upward movement of the coupling pin 37 relative to the coupling pin 9 is not possible as the locking pin 36 on the end of the ejection slider 10 facing the ejection force storage member 13 cannot yet move upwards as the locking pin 36 is still located in the tensioning section 78 of the locking guide track 41.

Figure 27:
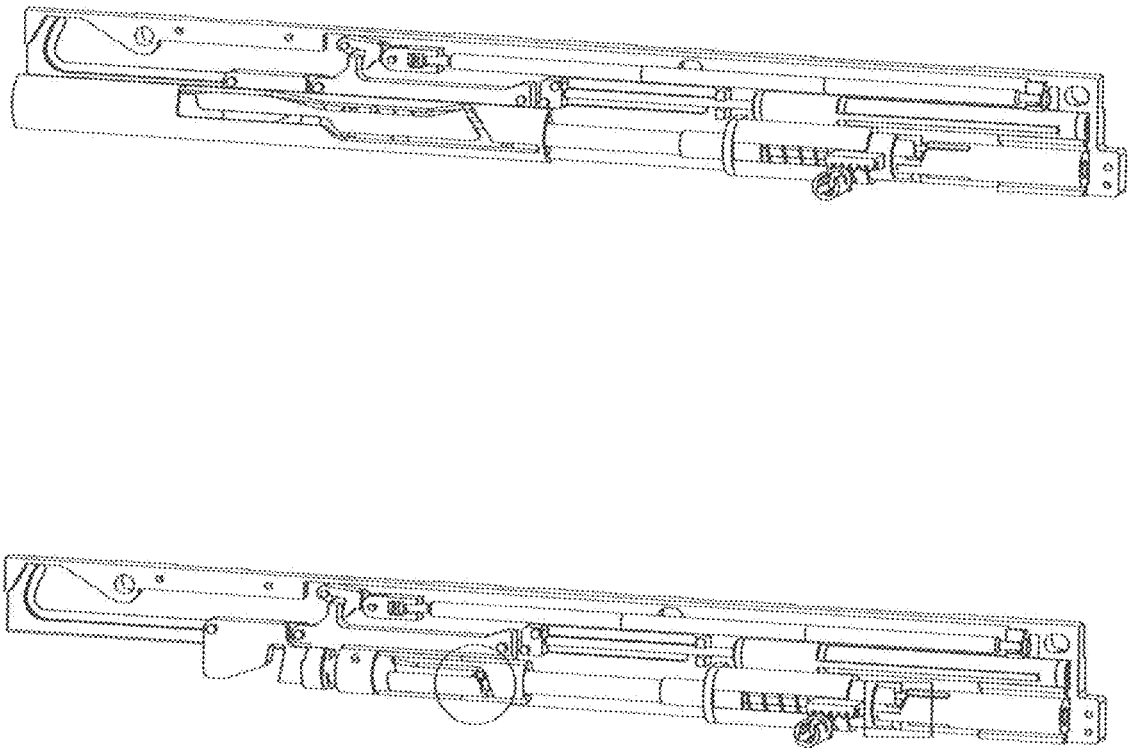

In FIG. 27, however, the ejection force storage member 13 is now tensioned so far that the locking pin 36 is no longer held in the tensioning section 78 but rather is able to reach a curved section 79 of the locking guide track 41. This movement of the locking pin 36 into the curved section 79 is carried out in a controlled manner by means of the coupling track 45. This means, as can be seen in the left detail of FIG. 27, the coupling pin 37 indeed abuts the inclined section 73 of the control track 45. As the locking pin 36 has reached the curved section 79, the ejection slider 10 is not able to rotate.

Figure 28:
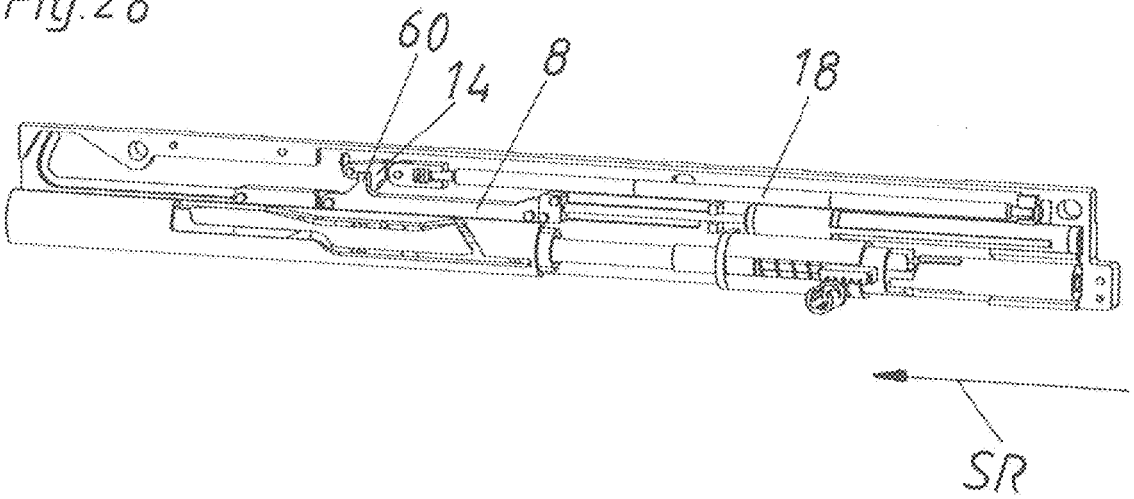
Figure 28:
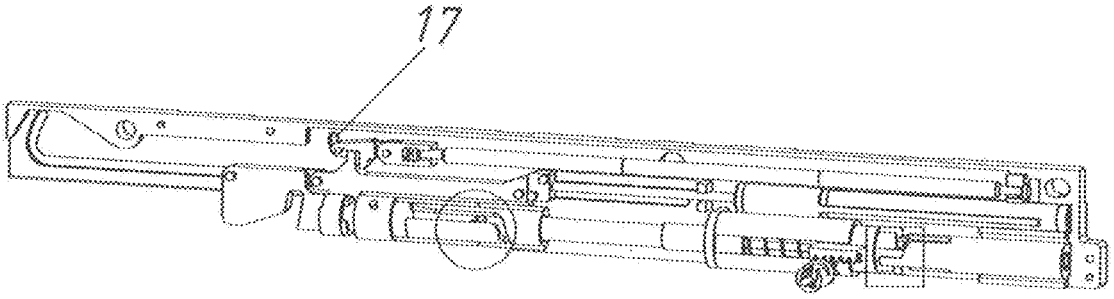
Figure 28:
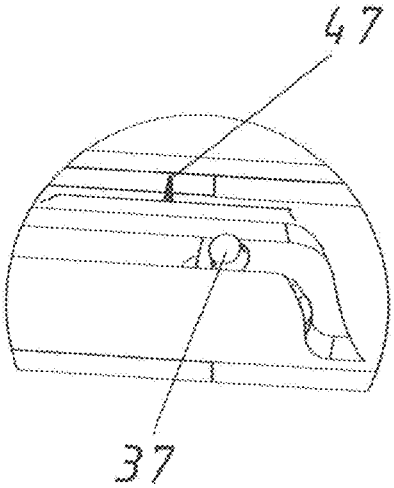
Figure 28:
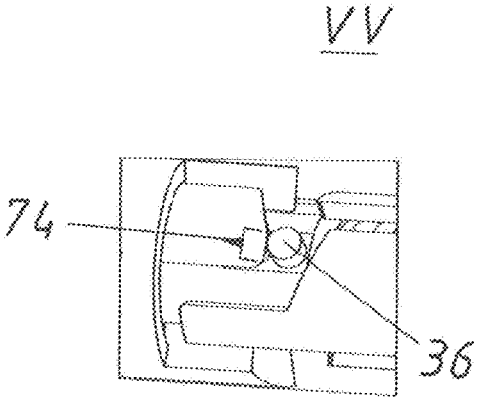

This rotational movement is coordinated in such a manner that the coupling pin 37 reaches the guiding and idling section 47 when the locking pin 36 is exactly located in a pre-locking section 74 of the locking guide track 41 (see FIG. 28). The pre-locking section 74 is oriented rectangular to the longitudinal axis L. While the locking pin 36 is located in this pre-locking section 74, the ejection force storage member 36 is tensioned and a pre-locking position VV is reached. For details to this pre-locking position VV it shall exemplarily be referred to the WO 2014/165878 A1. This pre-locking position W enables a through-pressing protection so that an undesired unlocking is not immediately occurring when closing. In FIG. 28 it is also recognizable that directly after reaching the pre-locking position VV or with reaching this position the push nose 60 of the push element 8 engages the retraction latch 14 and releases this retraction latch 14 from the angled end section of the retraction locking track 17. As a consequence, the retraction force storage member 18 starts to relax and the movable furniture part 2 is actively retracted in closing direction SR.

Figure 29:
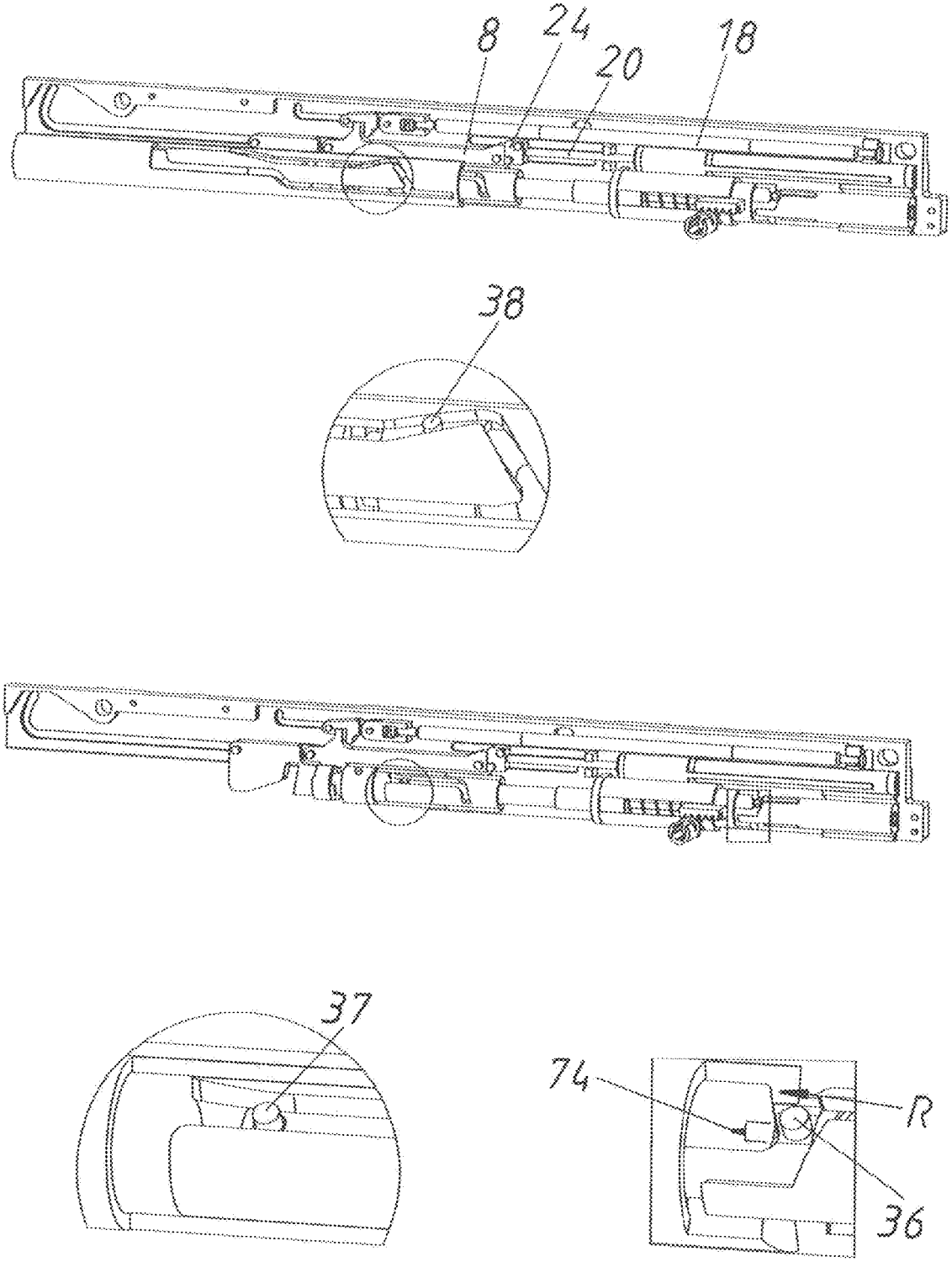

In FIG. 29 about the half of the retraction path is already traveled. The retraction force storage member 18 has already relaxed for a large part. This retraction movement is damped by the damping piston 20 of the damping device 5 as the damping piston 20 acts in a braking manner onto the push element 8 via the intermediate piece 24. In the upper detail of FIG. 29 the control pin 38 has reached the latching control track section 68 of the control track 40. By the inclined design of this latching control track section 68 the coupling element 9 rotated upwards relative to the housing cover 6. As the coupling pin 37 simultaneously abuts the guiding and idling section 47 of the upward rotating coupling track 45, also the ejection slider 10 is slightly rotated upwards. As a consequence, according to the lower right detail of FIG. 29 the locking pin 36 is moved away from the pre-locking section 74 and moves along the latching slope into the latch recess R of the locking device 56. Thus, also the movement of the locking pin 36 from the pre-locking section 74 into the latch recess R is controlled by means of the control track 40 and the coupling track 45 and the corresponding control pin 38 and coupling pin 37. Therefore, a smooth and quiet placing of the locking pin 36 in the latch recess R is reached. The control track 40, the control pin 38 guided in the control track 40, the coupling track 45 in the coupling element 9 and the coupling pin 37 guided in the coupling track 45 and arranged on the ejection slider 10 together form the control device for controlling the movement of the locking pin 36 arranged on the ejection slider 10 and guided in the locking guide track 41.

Figure 30:
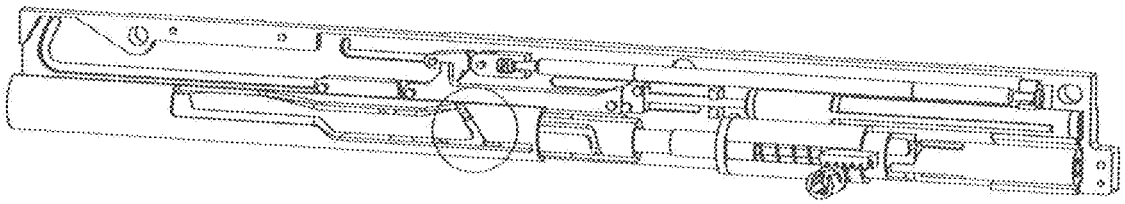
Figure 30:
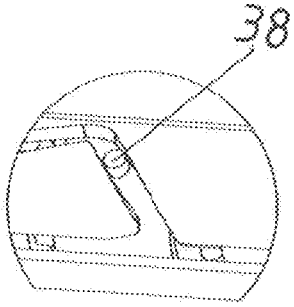
Figure 30:
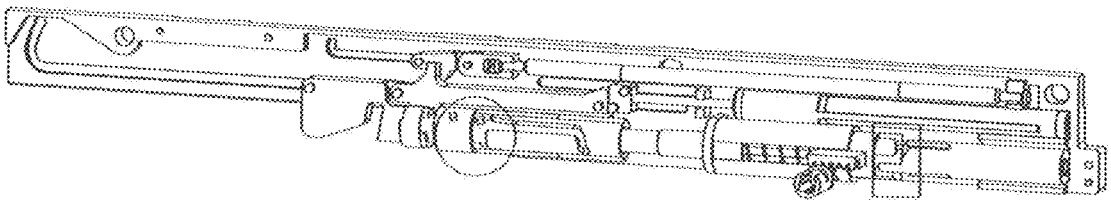
Figure 30:
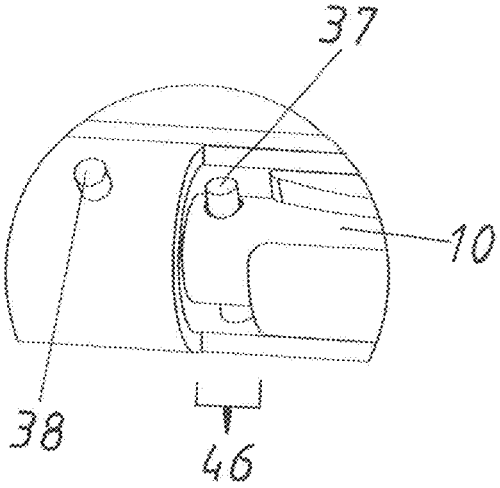
Figure 30:
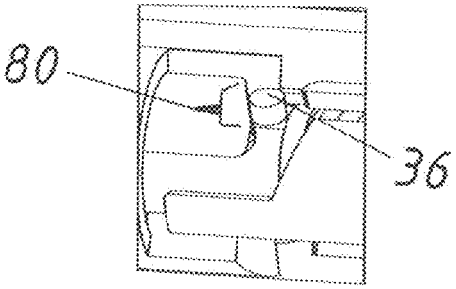

According to FIG. 30 the locking pin 36 has finally reached the latch recess R and the locking device 56 is in the locking position VS. Simultaneously, the coupling pin 37 is in the freewheel section 46 of the coupling track 45 according to the detail bottom left. In the upper detail the control pin 38 has moved into the uncoupling control track section 69 of the control track 40. As a consequence, a rotational movement of the coupling element 9 relative to the housing cover 6 about 70° to 150°, preferably about circa 120°, is triggered. In order to not hinder this relatively large rotational movement of the coupling element 9, the coupling pin 37 is located in the freewheel section 46 of the coupling element 9 as the ejection slider 10 indeed cannot rotate because of the locking of the locking pin 36. Also the ejection slider 10 is freely rotatable relative to the coupling element 9 by this freewheel section 46. The retraction movement by the retraction device 4 is almost completed in FIG. 30.

Figure 31:
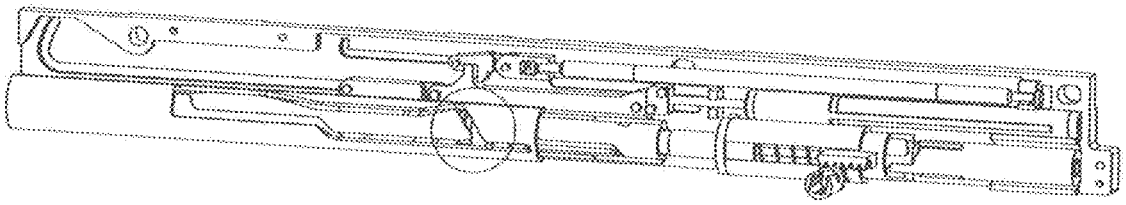
Figure 31:
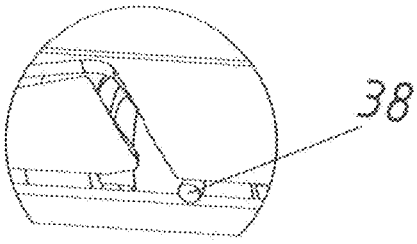
Figure 31:
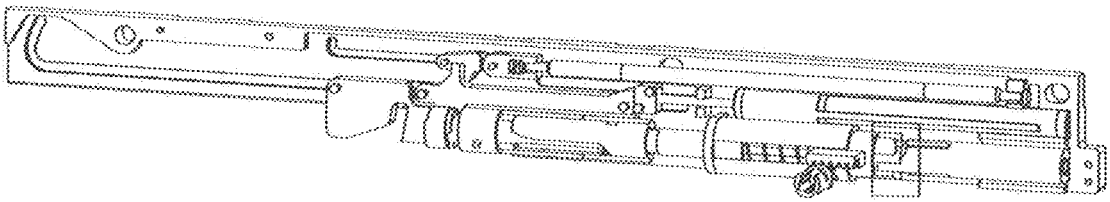
Figure 31:
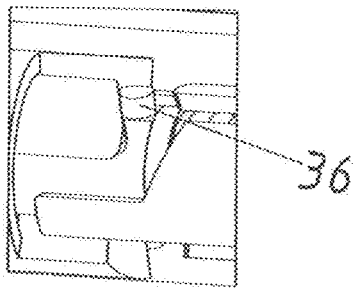

In FIG. 31, finally, the closed position SS of the movable furniture part 2 is reached. The control pin 38 is again located in an uncoupling region EK of the control track 40, whereby the coupling between the coupling element 9 and the push element 8 is released. FIG. 31 again corresponds to the starting position according to FIG. 15.

Figure 32:
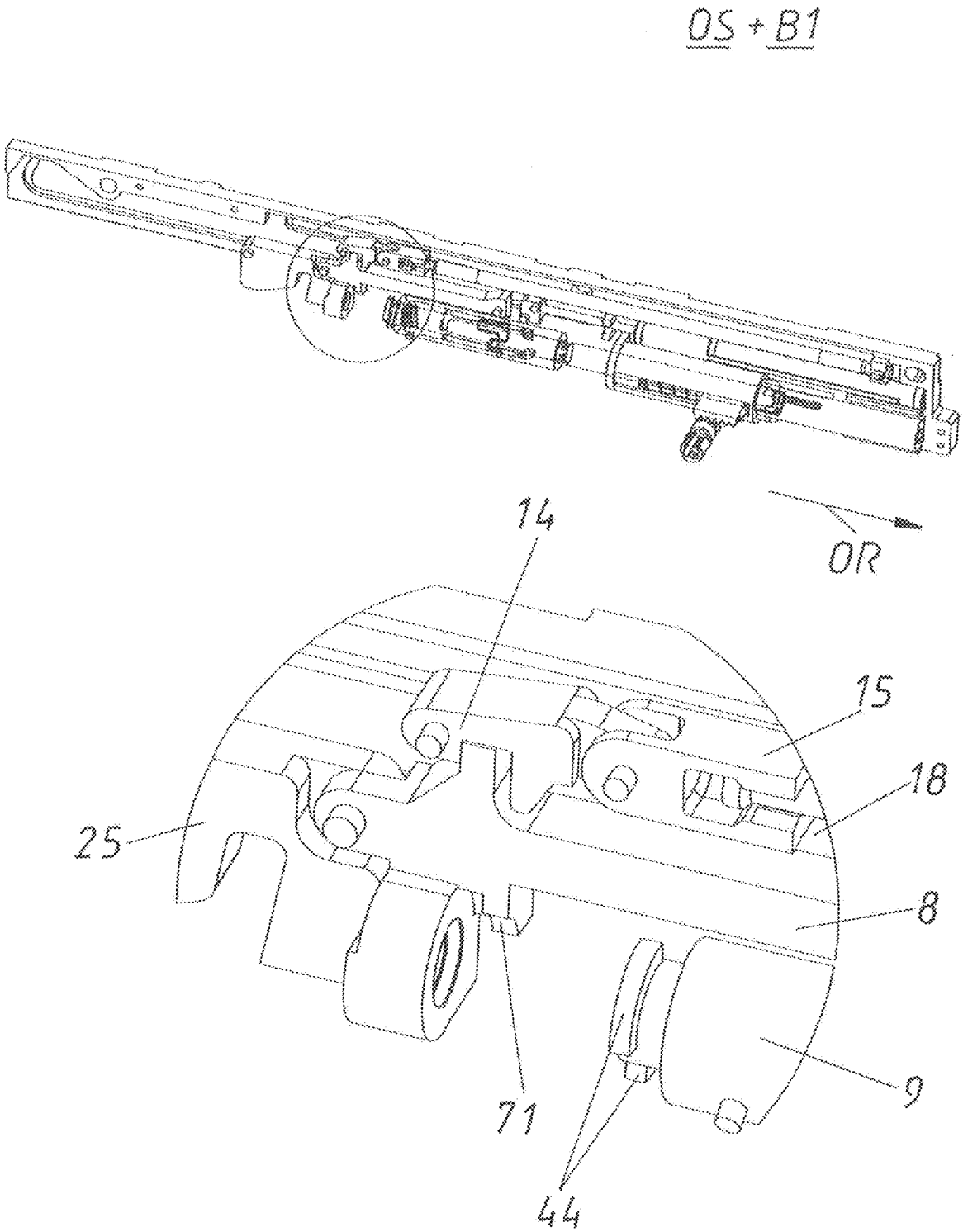

In FIG. 32 a further important function of the present drive device 1 is recognizable. With the present drive device 1 it is specifically possible, without having to use an overload device or other auxiliary devices, to pull the movable furniture part 2 from the closed position SS in opening direction OR without generating damages. This means, not only an opening of the movable furniture part 2 by over-pressing and thus triggered unlocking as in the second operating mode B2 is possible, but rather also a pulling of the movable furniture part 2 can be carried out. This is possible in such a way that in the closed position SS the coupling element 9 is uncoupled from the push element 8. As a consequence, the locking device 46 maintains the locking position VS and also the ejection device 3 remains unchanged. By this opening by pulling in the first operating mode B1 only the retraction device 4 is actively and manually tensioned so that in the case of a further closing a smooth closing sequence is guaranteed. For detailed information to this function it can exemplarily be referred to the WO 2014/165873 A1.

In principle it is possible that the drive device 1 comprises separate entrainment members for coupling the ejection device 3 and the retraction device 4 with the movable furniture and with the furniture carcass 51 respectively. For a simple design and mounting, however, it is preferably provided that the drive device 1 comprises only one entrainment member 49. The ejection device 3 as well as the retraction device 4 can be triggered by means of this single entrainment member 49. The first operating mode B1 can be activated by this entrainment member 49 by pulling the movable furniture part 2 situated in the closed position SS. The second operating mode B2 can be activated by this entrainment member 49 by pressing onto the movable furniture part 2 situated in the closed position SS.

Figure 33:
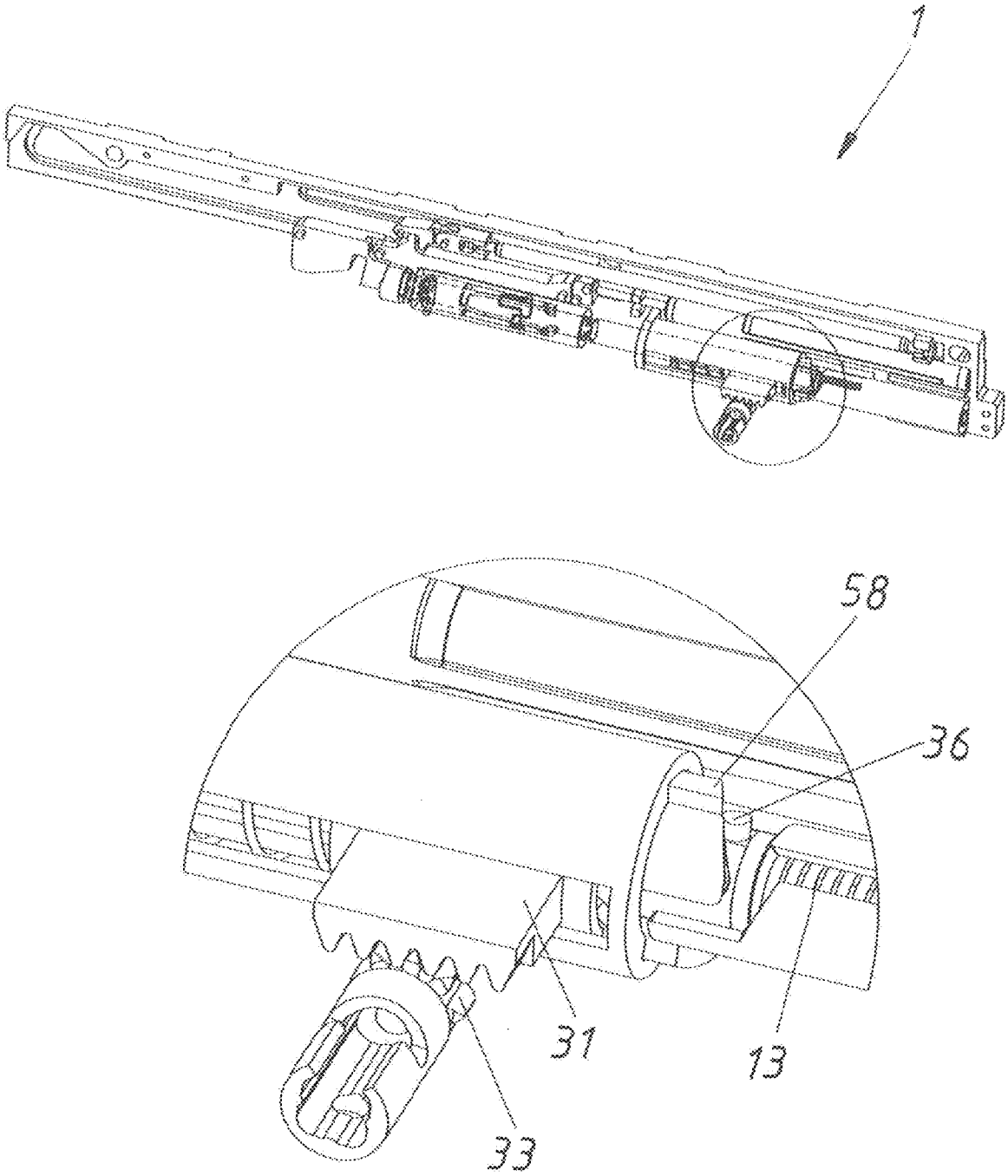

A further function of the drive device 1 is illustrated in FIG. 33. According to this illustration the unlocking of the locking pin 36 from the latch recess is not carried out by over-pressing, but rather in such a way that the drive device located on the other side (shown in FIG. 2) is unlocked by over-pressing. By way of the locking device 56 of the other drive device and especially by the synchronizing coupling piece 31 moving during opening, a movement is transmitted to the synchronizing coupling counter piece 33 and the synchronizing rod 76 (shown in FIG. 2) so that in the case of the drive device 1 shown in FIG. 33 also the synchronizing coupling piece 31 is moved while the just beginning opening movement. As the synchronizing coupling piece 31 is integrally formed with the locking element 58, the locking element 58 does no longer jointly form the latch recess R, whereby the locking pin 36 is able to reach the ejection section because of the inclined locking guide track 41 and because of the spring-actuation by the ejection force storage member 13. For details to this function it shall exemplarily be referred to the WO 2015/051386 A2.

Figure 34:
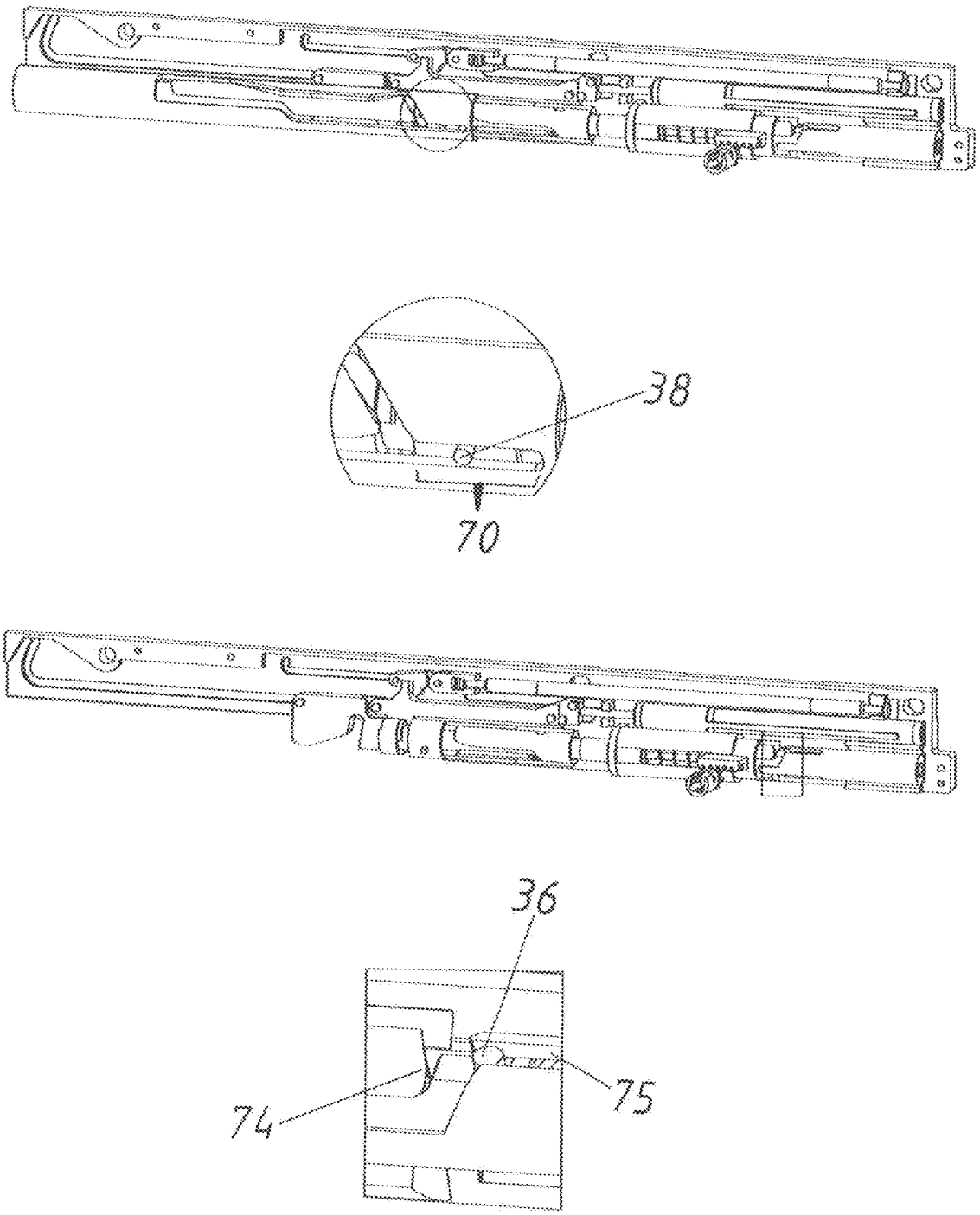

Finally, it shall be referred to the FIG. 34 in which a through-pressing movement is illustrated. In the case of this through-pressing movement the locking pin 36 is moved from the pre-locking section 74 into the through-pressing track 75 of the locking guide track 41. Simultaneously, also the control pin 38 is located in a through-pressing control track section 70 of the control track 40. By this function and especially by the through-pressing track 75 it is prevented that a direct through-pressing and thus over-pressing and triggering happens when closing. Thus, the locking pin 36 cannot directly reach the ejection section of the locking guide track 41.

LIST OF REFERENCE SIGNS

1, 1' drive device
2 movable furniture part
3 ejection device
3' further ejection device
4 retraction device
5 damping device
6 housing cover
7 housing base plate
8 push element
9 coupling element
10 ejection slider
11 inner ejection housing
12 outer ejection housing
13 ejection force storage member
14 retraction latch
15 retraction slider
16 retraction connecting pin
17 retraction locking track
18 retraction force storage member
19 retraction force storage member base
20 damping piston
21 damping cylinder
22 damping piston guide
23 retraction locking pin
24 intermediate piece
25 catch hook
26 catch hook force storage member
27 catch hook rotary bearing
28 guide track for the catch hook and the push element
29 guiding bolt
30 separating element
31 synchronizing coupling piece
32 synchronizing force storage member
33 synchronizing coupling counter piece
34 synchronizing guide
35 synchronizing rod holder
36 locking pin
37 coupling pin
38 control pin
39 intermediate piece guide track
40 control track
41 locking guide track
42 deflection slope
43 hemisphere-shaped abutment
44 bajonet-like coupling parts
45 coupling track
46 freewheel section
47 guiding and idling section
48 holding section
49 entrainment member
50 item of furniture
51 furniture carcass
52 extension guide
53 carcass rail
54 drawer rail
55 central rail
56 locking device
57 opening for the synchronizing coupling piece
58 locking element
59 catch section
60 push nose
61 ejection control track section
62 coupling control track section
63 shifting control track section
64 redirecting control track section
65 tensioning control track section
66 deflection control track section
67 holding control track section
68 latching control track section
69 uncoupling control track section
70 through-pressing control track section
71 projection on the push element
72 holding surface
73 inclined section
74 pre-locking section
75 through-pressing track
76 synchronizing device
77 synchronizing rod
78 tensioning section
79 curved section
80 latching section R latch recess
EK uncoupling region
K coupling region
SS closed position
ÜS over-pressing position
OS open position
SR closing direction
OR opening direction
VS locking position
ES unlocking position
VV pre-locking position
B1 first operating mode
B2 second operating mode
L longitudinal axis/direction
X rotational axis

The invention claimed is:

1. A drive device for a movable furniture part, the drive device comprising:
an ejection device for ejecting the movable furniture part from a closed position into an open position;
a locking device for locking the ejection device in a locking position; and
a control device,
wherein:
the locking device comprises a locking guide track and a locking pin which is movable and lockable in the locking guide track;
the control device is separate from the locking guide track and the locking pin and movement of the locking pin in the locking guide track can be at least partially controlled by the control device;
the locking pin is on a carrier;
the control device comprises a coupling pin on the carrier and a coupling track;
the locking guide track comprises a tensioning section substantially oriented in a longitudinal direction, a curved section, a pre-locking section and a latching section; and
rotational movement of the carrier about a rotational axis can be triggered via the locking pin when leaving the tensioning section by the coupling pin simultaneously situated in an inclined section of the coupling track and being deflected by the inclined section and, due to the rotational movement of the carrier, movement of the locking pin along the curved section into the pre-locking section can be controlled.

2. The drive device according to claim 1, wherein movement of the carrier can be controlled by the control device.

3. The drive device according to claim 2, wherein the rotational axis is oriented parallel to a longitudinal axis of the ejection device.

4. The drive device according to claim 2, wherein the coupling track is in a coupling element.

5. The drive device according to claim 4, wherein the coupling track comprises a holding surface for holding the coupling pin and the inclined section for deflecting the coupling pin into a guiding section of the coupling track.

6. The drive device according to claim 5,
wherein the control device comprises a control track, and a control pin which is configured to engage the control track and is on the coupling element, and
wherein rotational movement of the coupling element about the rotational axis can be triggered by movement of the control pin along an inclined deflection control track section of the control track so that the coupling pin travels from the holding surface into the inclined section of the coupling track in the coupling element.

7. The drive device according to claim 4, wherein the control device comprises a control track, and a control pin which is configured to engage the control track and is on the coupling element.

8. The drive device according to claim 1, wherein a housing of the drive device, a coupling element and the carrier are at least partly sleeve-shaped or cylindrical.

9. The drive device according to claim 8,
wherein an ejection housing together with the locking guide track therein, the coupling element together with the coupling track therein and the housing together with a control track therein are cylindrical, and
wherein each of the locking guide track, the coupling track and the control track is on a cylinder jacket surface vaulted about the rotational axis.

10. The drive device according to claim 1, wherein the locking position can be unlocked by over-pressing the movable furniture part into an over-pressing position located behind the closed position.

11. The drive device according to claim 1, wherein the ejection device comprises an ejection force storage member and an ejection slider configured to be force-actuated by the ejection force storage member.

12. The drive device according to claim 11, wherein the ejection slider forms the carrier.

13. The drive device according to claim 1, further comprising a housing, wherein the ejection device and a retraction device for retracting the movable furniture part from the open position into the closed position are in the housing.

14. The drive device according to claim 13,
wherein the retraction device comprises a retraction force storage member held on the housing, a retraction locking track in the housing and a lockable retraction slider, and
wherein the lockable retraction slider is configured to be force-actuated by the retraction force storage member and is movable in the retraction locking track.

15. The drive device according to claim 13, wherein the ejection device can be coupled to the retraction device by a push element and a coupling element.

16. An item of furniture comprising:
a furniture carcass;
a movable furniture part; and
the drive device according to claim 1 for the movable furniture part.

17. The item of furniture according to claim 16, wherein the drive device is on the movable furniture part.

18. The drive device according to claim 1, wherein the movable furniture part is a drawer.

19. The item of furniture according to claim 17, wherein the drive device is on a drawer rail of an extension guide for the movable furniture part.

20. A drive device for a movable furniture part, the drive device comprising:
an ejection device for ejecting the movable furniture part from a closed position into an open position;
a locking device for locking the ejection device in a locking position; and
a control device,
wherein:
the locking device comprises a locking guide track and a locking pin which is movable and lockable in the locking guide track;
the control device is separate from the locking guide track and the locking pin and movement of the locking pin in the locking guide track can be at least partially controlled by the control device;

the control device comprises a coupling track, a coupling pin, a control track, and a control pin which is configured to engage the control track and is on a coupling element;

rotational movement of the coupling element about a rotational axis can be triggered by movement of the control pin along an inclined latching control track section of the control track; and the coupling pin is configured to engage a guiding section of the coupling track and participate in the rotational movement of the coupling element.

21. The drive device according to claim 20, further comprising a carrier which is movable relative to the locking guide track by movement transmission of the rotational movement of the coupling element to the coupling pin, wherein:

the locking guide track comprises a pre-locking section, a latching section, and a latch recess; and the locking pin is on the carrier and is configured to travel in a controlled manner from the pre-locking section via the latching section into the latch recess.

22. A drive device for a movable furniture part, the drive device comprising:

an ejection device for ejecting the movable furniture part from a closed position into an open position;

a locking device for locking the ejection device in a locking position; and a control device, wherein:

the locking device comprises a locking guide track in an ejection housing and a locking pin which is movable and lockable in the locking guide track;

the control device is separate from the locking guide track and the locking pin, and movement of the locking pin in the locking guide track can be at least partially controlled by the control device;

the locking pin is on a carrier;

movement of the carrier can be controlled by the control device;

the control device comprises a control track, a coupling pin on the carrier and a coupling track in a coupling element;

a housing of the drive device, the coupling element and the carrier are at least partly sleeve-shaped or cylindrical;

the ejection housing together with the locking guide track therein, the coupling element together with the coupling track therein and the housing together with the control track therein are cylindrical, and each of the locking guide track, the coupling track and the control track is on a cylinder jacket surface vaulted about a rotational axis.

* * * * *